US007289741B2

(12) United States Patent
Kikuchi

(10) Patent No.: US 7,289,741 B2
(45) Date of Patent: Oct. 30, 2007

(54) IMAGE FORMING APPARATUS, UNIT FOR INSTALLATION IN THE IMAGE FORMING APPARATUS, AND ADMINISTRATION SYSTEM MONITORING USE STATE OF THE IMAGE FORMING APPARATUS

(75) Inventor: Hideo Kikuchi, Yokohama (JP)

(73) Assignee: Ricoh Company Ltd., Tokyo (JP)

( * ) Notice: Subject to any disclaimer, the term of this patent is extended or adjusted under 35 U.S.C. 154(b) by 299 days.

(21) Appl. No.: 10/926,224

(22) Filed: Aug. 26, 2004

(65) Prior Publication Data

US 2005/0084272 A1 Apr. 21, 2005

(30) Foreign Application Priority Data

Aug. 26, 2003 (JP) ..... 2003-301977
Aug. 28, 2003 (JP) ..... 2003-305296

(51) Int. Cl.
*G03G 15/00* (2006.01)

(52) U.S. Cl. ..... 399/12; 399/111

(58) Field of Classification Search ..... 399/12, 399/111

See application file for complete search history.

(56) References Cited

U.S. PATENT DOCUMENTS 4,310,153 A 1/1982 Kikuchi
4,330,200 A 5/1982 Kikuchi et al.
4,349,190 A 9/1982 Kaneko et al.
4,353,543 A 10/1982 Ikeda et al.
4,361,319 A 11/1982 Ikeda et al.
4,361,320 A 11/1982 Kikuchi et al.
4,365,887 A 12/1982 Kakitani et al.
4,439,865 A 3/1984 Kikuchi et al.
4,445,680 A 5/1984 Kikuchi et al.
4,449,813 A 5/1984 Kikuchi et al.
4,482,147 A 11/1984 Hibi et al.
4,961,088 A * 10/1990 Gilliland et al.
5,225,871 A * 7/1993 Tanimoto
6,339,684 B1 * 1/2002 Sato et al. ..... 399/12
6,658,219 B1 * 12/2003 Ito et al. ..... 399/12

FOREIGN PATENT DOCUMENTS

JP 09244966 A * 9/1997
JP 2001-296786 10/2001
JP 2002-120438 4/2002
JP 2003066774 A * 3/2003

OTHER PUBLICATIONS

U.S. Appl. No. 11/083,036, filed Mar. 18, 2005, Yoshizawa.
U.S. Appl. No. 11/203,973, filed Aug. 16, 2005, Kikuchi et al.

* cited by examiner

*Primary Examiner*—Susan Lee
(74) *Attorney, Agent, or Firm*—Oblon, Spivak, McClelland, Maier & Neustadt, P.C.

(57) ABSTRACT

An image forming apparatus includes a unit having a first non-volatile memory holding recognition information of the unit and a main body in which the unit is installed in a replaceable manner. The main body has a second non-volatile memory holding a plurality of second recognition information concerning a plurality of units and a plurality of control information corresponding to the plurality of second recognition information. The image forming apparatus is configured such that when a comparison is made between the recognition information held in the first non-volatile memory and the plurality of second recognition information held in the second non-volatile memory and the recognition information held in the first non-volatile memory does not accord with any of the plurality of second recognition information held in the second non-volatile memory, an image forming operation is performed based on selected control information.

34 Claims, 22 Drawing Sheets

| |
|---|
| FIG. 5A |
| FIG. 5B |

| FIG. 7A |
| --- |
| FIG. 7B |

| FIG. 8A |
| --- |
| FIG. 8B |

| FIG. 12A |
| --- |
| FIG. 12B |

| FIG. 14A |
| --- |
| FIG. 14B |

IMAGE FORMING APPARATUS, UNIT FOR INSTALLATION IN THE IMAGE FORMING APPARATUS, AND ADMINISTRATION SYSTEM MONITORING USE STATE OF THE IMAGE FORMING APPARATUS

CROSS-REFERENCE TO RELATED APPLICATIONS

The present application claims priority and contains subject matter related to Japanese Patent Applications No. 2003-301977 and No. 2003-305296 filed in the Japanese Patent Office on Aug. 26, 2003 and Aug. 28, 2003, respectively, and the entire contents of each of which are hereby incorporated herein by reference.

BACKGROUND OF THE INVENTION

1. Field of the Invention

The present invention relates to an image forming apparatus such as: a copier, a printer, a facsimile apparatus, a multi-function apparatus, etc.; a unit for installation in the image forming apparatus in a replaceable manner; and an administration system monitoring the status of the image forming apparatus.

2. Discussion of the Background

In an image forming apparatus such as a color copier, a printer, etc., a number of units for installation in the image forming apparatus, such as a process cartridge, etc., are configured to be freely detachable from the main body of the apparatus. In such an image forming apparatus, when a unit in the apparatus is exhausted or malfunctions, the unit is replaced by the user or service person with another unit in mint condition.

Here, units in mint condition include a new unit manufactured at a factory and a recycled unit which has been collected after having been used in an image forming apparatus and processed for recycling at a recycling factory.

Recently, with rising of consciousness of resource saving, recycled units for image forming apparatuses are increasingly provided by manufacturers other than manufacturers of image forming apparatuses.

On the other hand, a technology to control an image forming apparatus according to information on a process cartridge installed in the main body of the image forming apparatus in a replaceable manner is disclosed, for example, in Japanese Patent laid-open publication No. 2001-296786. Specifically, when the type of an installed process cartridge has been determined to be one of the listed types, the image forming apparatus is controlled in conformity with the installed process cartridge. When the type of the installed process cartridge has been determined not to be one of the listed types, image formation is unconditionally prohibited.

Japanese Patent laid-open publication No. 2002-120438 describes a technology to obtain a main control program optimum for a process cartridge installed in the main body of an image forming apparatus in a replaceable manner, according to an ID of the process cartridge, via a network. Specifically, first, the version of the main control program corresponding to the ID of the process cartridge is checked, and then, the main control program corresponding to the version is downloaded to the image forming apparatus via the network.

In the above-described image forming apparatus, when a process cartridge has been replaced with a new one or a recycled one, sometimes the image quality of the output image deteriorates.

More specifically, when an image forming apparatus is manufactured at a factory, various adjustments are made to the image forming apparatus in the state that a process cartridge has been installed in the main body of the apparatus. The adjustments include fine adjustments to obtain the best image quality, and a considerable number of adjustments are made to the process cartridge and the main body of the apparatus in one-to-one correspondence. Therefore, if the process cartridge in the main body of the image forming apparatus after such adjustments have been made is replaced with another process cartridge, then often image quality that is exactly the same as the one obtained in the apparatus before the process cartridge has been replaced cannot be duplicated.

The above-described problem becomes obvious in an image forming apparatus used at a customer's place when a service person performs replacement in the image forming apparatus. That is, when a process cartridge installed in an image forming apparatus becomes exhausted or malfunctions and is replaced with a replacement process cartridge, image quality of the apparatus sometimes deteriorates.

When the replacement process cartridge is one of the manufacturer's parts (quality of which is overseen by the manufacturer of the image forming apparatus), difference in image quality before and after making replacement of the process cartridge with the replacement process cartridge is nearly unnoticeable. This is because the image forming apparatus, the process cartridge, and the replacement process cartridge are designed and manufactured such that even when replacement of the process cartridge with the replacement process cartridge is made in the image forming apparatus, the difference in image quality before and after making the replacement is minimal. The same applies to a recycled process cartridge recycled by the manufacturer of the image forming apparatus.

On the other hand, when the replacement process cartridge is one manufactured by a manufacturer other than the manufacturer of the image forming apparatus (the quality of which are not overseen by the manufacturer of the image forming apparatus), there is a possibility that the difference in image quality before and after replacement of a process cartridge with the replacement process cartridge is not negligible. This is because there is a possibility that the replacement process cartridge is not designed and manufactured such that when replacement of a process cartridge with the replacement process cartridge is made in an image forming apparatus, difference in image quality before and after the replacement is minimum. The same applies to a recycled process cartridge recycled by a manufacturer other than the manufacture of the image forming apparatus. Recycled process cartridges may include those process cartridges manufactured by the manufacturer of an image forming apparatus and recycled by a manufacturer other than the manufacturer of the image forming apparatus and those process cartridges manufactured and recycled by the manufacturer other than the manufacturer of the image forming apparatus.

The technology described in Japanese Patent laid-open publication No. 2002-120438 cannot optimize image quality in an image forming apparatus when such a process cartridge, the quality of which is not overseen by the manufacturer of the image forming apparatus, is installed in the apparatus as a replacement.

The above-described problem in image quality might not be negligible in particular in color image forming apparatuses in which relatively high image quality is demanded.

In relation to the above-described problem, for example, Japanese Patent laid-open publications No. 2003-29583 and No. 2003-58003 describe a technology to disable installment of a process cartridge that cannot be identified, in the main body of an image forming apparatus, e.g., a process cartridge manufactured by a manufacturer other than the manufacturer of the image forming apparatus.

However, among those process cartridges manufactured by a manufacturer other than the manufacturer of an image forming apparatus, there may be one that, when installed in the image forming apparatus as a replacement, can maintain satisfactory image quality comparable with the image quality obtained when a process cartridge manufactured by the manufacturer of the image forming apparatus is installed in the apparatus. In particular, even when a replacement recycled process cartridge is one of those processed for recycling by a manufacturer other than the manufacturer of an image forming apparatus, if the replacement recycled process cartridge is the one manufactured by the manufacturer of the image forming apparatus, there is a strong possibility that satisfactory image quality can be maintained. Forbidding installment of such a replacement recycled process cartridge in an image forming apparatus across the board restricts alternatives for the user of the image forming apparatus, which is inappropriate.

The above-described problem is common to each unit that is configured to be installed in the main body of an image forming apparatus in a replaceable manner and that, when installed in the main body of the image forming apparatus to replace a previously installed unit, may cause differences in image quality before and after installment of the unit in the main body of the image forming apparatus, e.g., a photoconductor drum, a charging unit, a development unit, a toner cartridge, a cleaning unit, an optical unit, a transfer unit, a sheet feeding unit, a fixing unit, etc.

SUMMARY OF THE INVENTION

The present invention has been made in view of the above-discussed and other problems and addresses the above-discussed and other problems.

Preferred embodiments of the present invention provide a novel image forming apparatus that can operate in an optimum condition regardless of whether or not a replaceable unit installed in the apparatus is one manufactured by the manufacturer of the apparatus or one manufactured by a manufacturer other than the manufacturer of the apparatus, regardless of whether or not the installed unit is new or recycled, and regardless of the condition of the installed unit, so that the user can use the apparatus without anxiety.

The preferred embodiments of the present invention further provide a replaceable novel unit that is installed in an image forming apparatus and can always operate in an optimum condition in the apparatus regardless of the manufacturer of the unit, regardless of whether or not the unit is new or recycled, and regardless of the condition of the unit, so that the user can use the image forming apparatus without anxiety.

The preferred embodiments further provide a novel administration system that monitors the status of an image forming apparatus including a unit installed in the main body of the apparatus in a replaceable manner and that provides control information optimum for the installed unit to the image forming apparatus, so that the user can use the image forming apparatus without anxiety.

According to a preferred embodiment of the present invention, an image forming apparatus includes a unit having a first non-volatile memory holding recognition information of the unit, and a main body in which the unit is installed in a replaceable manner. The main body has a second non-volatile memory holding a plurality of second recognition information corresponding to a plurality of units and a plurality of control information corresponding to the plurality of second recognition information. The image forming apparatus is configured such that when a comparison is made between the recognition information held in the first non-volatile memory and the plurality of second recognition information held in the second non-volatile memory and the recognition information held in the first non-volatile memory does not accord with any of the plurality of second recognition information held in the second non-volatile memory, an image forming operation is performed based on selected control information.

In the above-described image forming apparatus, the selected control information may be control information resembling control information of the unit concerning the recognition information, in the plurality of control information.

Further, in the above-described image forming apparatus, the second non-volatile memory may further hold predetermined standard control information, and in this case, the selected control information may be the standard control information.

Furthermore, in the above-described image forming apparatus, the second non-volatile memory may further hold control information used in an image forming operation before the comparison between the recognition information held in the first non-volatile memory and the plurality of second recognition information held in the second non-volatile memory has been made, and in this case, the selected control information may be the control information used in an image forming operation before the comparison was made.

Still further, in the above-described image forming apparatus, the second non-volatile memory may further hold predetermined standard control information, and when control information resembling the control information of the unit concerning the recognition information exists in the plurality of control information, the selected control information may be the control information resembling the control information of the unit concerning the recognition information. When the control information resembling to control information of the unit concerning the recognition information does not exist in the plurality of control information, the selected control information may be the standard control information.

Furthermore, in the above-described image forming apparatus, the second non-volatile information may further hold predetermined standard control information and control information used in an image forming operation before the comparison between the recognition information held in the first non-volatile memory and the plurality of second recognition information held in the second non-volatile memory has been made, and in this case, when control information resembling the control information of the unit concerning the recognition information exists in the plurality of control information, the selected control information may be the control information resembling the control information of the unit concerning the recognition information. When the control information resembling the control information of the unit concerning the recognition information does not exist in the plurality of control information, the selected control information may be the standard control information. When the control information resembling to control information of the unit concerning the recognition information does not exist in the plurality of control information and the selected control information is not the standard control information, the selected control information may be the control information used in an image forming operation before the comparison between the recognition information held in the first non-volatile memory and the plurality of second recognition information held in the second non-volatile memory has been made.

Still further, the above-described image forming apparatus may further include a display part and an operation part. When the comparison between the recognition information held in the first non-volatile memory and the plurality of second recognition information held in the second non-volatile memory is made and the recognition information held in the first non-volatile memory does not accord with any of the plurality of second recognition information held in the second non-volatile memory, the display part may display an indication to the effect that the recognition information does not accord with any of the plurality of third recognition information and a confirmation indication as to if an image forming operation may be performed based on the selected control information, and the operation part may be configured for key inputting a confirmation that determines if an image forming operation may be performed based on the selected control information.

Still further, the above-described image forming apparatus may be configured such that when the comparison between the recognition information held in the first non-volatile memory and the plurality of second recognition information held in the second non-volatile memory is made and the recognition information held in the first non-volatile memory accords with at least one of the plurality of second recognition information held in the second non-volatile memory, the image forming operation is performed based on control information corresponding to recognition information of the plurality of second recognition information, according to the recognition information.

Furthermore, in the above-described image forming apparatus, the selected control information may be held in the second non-volatile memory.

Further, in the above-described image forming apparatus, the second non-volatile memory may be detachably mounted to a control part of the main body.

Still further, in the above-described image forming apparatus, the first non-volatile memory may be provided to an IC tag detachably mounted to the unit.

Still further, in the above-described image forming apparatus, the first non-volatile memory may be configured to communicate with a control part of the main body by serial communication.

Furthermore, in the above-described image forming apparatus, the comparison between the recognition information of the first non-volatile memory and the plurality of second recognition information of the second non-volatile memory may be made when the unit has been replaced.

Furthermore, in the above-described image forming apparatus, the unit may be a process cartridge in which at least one of a charging unit to charge an image bearing member, a development unit to develop a latent image formed on the image bearing member, and a cleaning unit to clean the image bearing member are supported integrally with the image bearing member.

Still further, in the above-described image forming apparatus, the unit may be an integrated unit in which at least one of an image bearing member, a charging unit to charge the image bearing member, a development unit to develop a latent image formed on the image bearing member, a transfer unit to transfer a toner image formed on the image bearing member to a transfer sheet, and a cleaning unit to clean the image bearing member are integrated.

Furthermore, in the above-described image forming apparatus, the unit may be a toner cartridge accommodating toner.

According to another preferred embodiment of the present invention, a unit for installation in the main body of the above-described image forming apparatus is provided. The unit is installed in the main body of the image forming apparatus in a replaceable manner and includes a first non-volatile memory holding recognition information of the unit. As described above, the main body of the image forming apparatus includes a second non-volatile memory holding a plurality of second recognition information concerning a plurality of units and a plurality of control information corresponding to the plurality of second recognition information, and the image forming apparatus is configured such that when a comparison is made between the recognition information held in the first non-volatile memory and the plurality of second recognition information held in the second non-volatile memory and the recognition information held in the first non-volatile memory does not accord with any of the plurality of second recognition information held in the second non-volatile memory, an image forming operation is performed based on selected control information.

According to still another preferred embodiment of the present invention, an image forming apparatus includes a unit having a first non-volatile memory holding recognition information of the unit, and a main body in which the unit is installed in a replaceable manner. The main body has a second non-volatile memory holding second recognition information concerning the unit. The image forming apparatus is configured to exchange information with an administration system monitoring a use state of the image forming apparatus, and when a comparison is made between the recognition information held in the first non-volatile memory of the unit and the second recognition information held in the second non-volatile memory of the main body and the recognition information held in the first non-volatile memory does not accord with the second recognition information held in the second non-volatile memory, information is transmitted to the administration system.

In the above-described image forming apparatus, the second recognition information may be a plurality of recognition information concerning a plurality of units, and when a comparison is made between the recognition information held in the first non-volatile memory of the unit and the second recognition information held in the second non-volatile memory of the main body and the recognition information held in the first non-volatile memory does not accord with any of the plurality of recognition information of the second recognition information held in the second non-volatile memory, information may be transmitted to the administration system.

Further, in the above-described administration system, the information transmitted to the administration system may include the recognition information held in the first non-volatile memory. Further, the administration system may hold a plurality of third recognition information concerning a plurality of units and a plurality of control information corresponding to the plurality of third recognition information and be configured to transmit, when third recognition information according with the transmitted recognition information is identified in the plurality of third recognition information, the third recognition information according with the transmitted recognition information to the image forming apparatus as information, and the image forming apparatus may be configured to receive and input the information received from the administration system. Still further, the administration system may include a database holding the plurality of third recognition information and the plurality of control information corresponding to the plurality of third recognition information and be configured to access a public database to supplement third recognition information according with the transmitted recognition information and corresponding control information to the database.

Still further, in the above-described image forming apparatus wherein the information transmitted to the administration system includes the recognition information held in the first non-volatile memory, the administration system may hold a plurality of third recognition information concerning a plurality of units and a plurality of control information corresponding to the plurality of third recognition information and be configured to transmit, when third recognition information according with the transmitted recognition information is not identified in the plurality of third recognition information, information to the effect that third recognition information according with the transmitted recognition information has not been identified in the plurality of third recognition information to the image forming apparatus, and the image forming apparatus may be configured to receive and input the information received from the administration system. Further, the image forming apparatus may further include a display part and an operation part. The display part may be configured to display, when the transmitting information has been inputted to the image forming apparatus, an indication that third recognition information according with the transmitted recognition information has not been identified in the plurality of third recognition information and a confirmation indication as to if an operation of the image forming apparatus may be continued, and the operation part may be configured for key inputting a confirmation that determines if the operation of the image forming apparatus may be continued.

Still further, in the above-described image forming apparatus wherein the information transmitted to the administration system includes the recognition information held in the first non-volatile memory, the administration system may hold a plurality of third recognition information concerning a plurality of units and a plurality of control information corresponding to the plurality of third recognition information and be configured to transmit, when third recognition information according with the transmitted recognition information is not identified in the plurality of third recognition information and third recognition information resembling the transmitted recognition information is identified in the plurality of third recognition information, control information corresponding to the third recognition information resembling the transmitted recognition information to the image forming apparatus, and the image forming apparatus may be configured to receive and input the information transmitted from the administration system. Further, the image forming apparatus may further include a display part and an operation part. The display part may be configured to display, when the transmitting information has been inputted to the image forming apparatus, an indication that third recognition information resembling the transmitted recognition information has not been identified in the plurality of third recognition information and a confirmation indication as to if an operation of the image forming apparatus may be continued, and the operation part may be configured for key inputting a confirmation that determines if the operation of the image forming apparatus may be continued.

Furthermore, in the above-described image forming apparatus wherein the information transmitted to the administration system includes the recognition information held in the first non-volatile memory, the administration system holds a plurality of third recognition information concerning a plurality of units and a plurality of control information corresponding to the plurality of third recognition information and is configured to transmit, when third recognition information according with the transmitted recognition information is identified in the plurality of third recognition information, the third recognition information according with the transmitted recognition information to the image forming apparatus, and the image forming apparatus is configured to receive and input the transmitting information received from the administration system, the information inputted from the administration system may be held in the first non-volatile memory.

Furthermore, in the above-described image forming apparatus wherein the information transmitted to the administration system includes the recognition information held in the first non-volatile memory, the administration system holds a plurality of third recognition information concerning a plurality of units and a plurality of control information corresponding to the plurality of third recognition information and is configured to transmit, when third recognition information according with the transmitted recognition information is identified in the plurality of third recognition information, the third recognition information according with the transmitted recognition information to the image forming apparatus, and the image forming apparatus is configured to receive and input the information received from the administration system, the transmitting information inputted from the administration system may be held in the second non-volatile memory.

Further, in the above-described image forming apparatus, the first non-volatile memory may be provided to an IC tag configured to be detachable from the unit.

Still further, in the above-described image forming apparatus, the second non-volatile memory may be detachably provided to a control part of the main body.

Still further, in the above-described image forming apparatus, the first non-volatile memory may be configured to exchange information with a control part of the main body by serial communication.

Furthermore, in the above-described image forming apparatus, the first non-volatile memory and the second non-volatile memory may be configured such that when the unit has been replaced, the comparison between the recognition information held in the first non-volatile memory and the second recognition information held in the second non-volatile memory is made.

Still furthermore, in the above-described image forming apparatus, the unit may be a process cartridge in which at least one or more of a charging unit to charge an image bearing member, a development unit to develop a latent image formed on the image bearing member, and a cleaning unit to clean the image bearing member are supported integrally with the image bearing member.

Still furthermore, in the above-described image forming apparatus, the unit may be an integrated unit in which at least one or more of an image bearing member, a charging unit to charge the image bearing member, a development unit to develop a latent image formed on the image bearing member, a transfer unit to transfer a toner image formed on the image bearing member to a transfer sheet, and a cleaning unit to clean the image bearing member are integrated.

Furthermore, in the above-described image forming apparatus, the unit may be a toner cartridge accommodating toner.

According to still another preferred embodiment of the present invention, an administration system monitoring the status of the above-described image forming apparatus is provided. The administration system is configured to exchange information with the image forming apparatus via a public communication line or the Internet. The image forming apparatus includes a unit having a first non-volatile memory holding recognition information of the unit and a main body in which the replaceable unit is installed and the main body has a second non-volatile memory holding second recognition information concerning the unit. The image forming apparatus is configured such that information is exchanged with the administration system and that when a comparison is made between the recognition information held in the first non-volatile memory of the unit and the second recognition information held in the second non-volatile memory of the main body and the recognition information held in the first non-volatile memory does not accord with the second recognition information held in the second non-volatile memory, information is transmitted to the administration system.

In the administration system, the second recognition information may be a plurality of recognition information concerning a plurality of units, and when a comparison is made between the recognition information held in the first non-volatile memory of the unit and the second recognition information held in the second non-volatile memory of the main body of the image forming apparatus and the recognition information held in the first non-volatile memory does not accord with any of the plurality of recognition information of the second recognition information held in the second non-volatile memory, information may be transmitted to the administration system. Further, the information transmitted to the administration system may include the recognition information held in the first non-volatile memory. Furthermore, the administration system may hold a plurality of third recognition information concerning a plurality of units and a plurality of control information corresponding to the plurality of third recognition information and be configured to transmit, when third recognition information according with the transmitted recognition information is identified in the plurality of third recognition information, the third recognition information according with the transmitted recognition information to the image forming apparatus as information, and the image forming apparatus may be configured to receive and input the information received from the administration system. Still further, the administration system may include a database holding the plurality of third recognition information and the plurality of control information corresponding to the plurality of the third recognition information and be configured to access a public database different from the database for retrieval to supplement third recognition information according with the transmitted recognition information and corresponding control information to the database.

Further, in the above-described administration system wherein the information transmitted to the administration system includes the recognition information held in the first non-volatile memory, the administration system may hold a plurality of third recognition information concerning a plurality of units and a plurality of control information corresponding to the plurality of third recognition information and be configured to transmit, when third recognition information according with the transmitted recognition information is not identified in the plurality of third recognition information, information that third recognition information according with the transmitted recognition information has not been identified in the plurality of third recognition information to the image forming apparatus, and the image forming apparatus may be configured to receive and input the information received from the administration system. Further, the image forming apparatus may include a display part and an operation part. The display part may be configured to display, when information has been inputted to the image forming apparatus, an indication that third recognition information according with the transmitted recognition information has not been identified in the plurality of third recognition information and a confirmation indication as to if an operation of the image forming apparatus may be continued, and the operation part may be configured for key inputting a confirmation that determines if the operation of the image forming apparatus may be continued.

Still further, in the above-described administration system wherein the information transmitted to the administration system includes the recognition information held in the first non-volatile memory, the administration system may hold a plurality of third recognition information concerning a plurality of units and a plurality of control information corresponding to the plurality of third recognition information and be configured to transmit, when third recognition information according with the transmitted recognition information is not identified in the plurality of third recognition information and third recognition information resembling the transmitted recognition information is identified in the plurality of third recognition information, control information corresponding to the third recognition information resembling the transmitted recognition information to the image forming apparatus, and the image forming apparatus may be configured to receive and input the information received from the administration system. Further, the image forming apparatus may include a display part and an operation part. The display part may be configured to display, when the transmitting information has been inputted to the image forming apparatus, an indication that third recognition information resembling the transmitted recognition information has not been identified in the plurality of third recognition information and a confirmation indication as to if an operation of the image forming apparatus may be continued, and the operation part may be configured for key inputting a confirmation that determines if the operation of the image forming apparatus may be continued.

Furthermore, in the above-described administration system wherein the information transmitted to the administration system includes the recognition information held in the first non-volatile memory, the administration system holds a plurality of third recognition information concerning a plurality of units and a plurality of control information corresponding to the plurality of third recognition information and is configured to transmit, when third recognition information according with the transmitted recognition information is identified in the plurality of third recognition information, the third recognition information according with the transmitted recognition information to the image forming apparatus, and the image forming apparatus is configured to receive and input the information received from the administration system, the received information may be held in the first non-volatile memory.

Still furthermore, in the above-described administration system wherein the information transmitted to the administration system includes the recognition information held in the first non-volatile memory, the administration system holds a plurality of third recognition information concerning a plurality of units and a plurality of control information corresponding to the plurality of third recognition information and is configured to transmit, when third recognition information according with the transmitted recognition information is identified in the plurality of third recognition information, the third recognition information according with the transmitted recognition information to the image forming apparatus, and the image forming apparatus is configured to receive and input the transmitting information received from the administration system, the received information may be held in the second non-volatile memory.

Further, in the above-described administration system, the first non-volatile memory may be provided to an IC tag configured to be detachable from to the unit.

Still further, in the above-described administration system, the second non-volatile memory may be detachably provided to a control part of the main body.

Still further, in the above-described administration system, the first non-volatile memory may be configured to exchange information with a control part of the main body by serial communication.

Furthermore, in the above-described administration system, the first non-volatile memory and the second non-volatile memory may be configured such that when the unit has been replaced, the comparison between the recognition information held in the first non-volatile memory and the second recognition information held in the second non-volatile memory is made.

Still furthermore, in the above-described administration system, the unit may be a process cartridge in which at least one of a charging unit to charge an image bearing member, a development unit to develop a latent image formed on the image bearing member, and a cleaning unit to clean the image bearing member are supported integrally with the image bearing member.

Still furthermore, in the above-described administration system, the unit may be an integrated unit in which at least one of an image bearing member, a charging unit to charge the image bearing member, a development unit to develop a latent image formed on the image bearing member, a transfer unit to transfer a toner image formed on the image bearing member to a transfer sheet, and a cleaning unit to clean the image bearing member are integrated.

Further, in the above-described administration system, the unit may be a toner cartridge accommodating toner.

Still further, the above-described administration system may include a database holding a plurality of third recognition information concerning a plurality of units and a plurality of control information corresponding to the plurality of third recognition information and the database may be configured to be accessible by unidentified third parties.

BRIEF DESCRIPTION OF THE DRAWINGS

A more complete appreciation of the present invention and many of the attendant advantages thereof will be readily obtained as the present invention becomes better understood by reference to the following detailed description when considered in conjunction with the accompanying drawings, wherein.

DETAILED DESCRIPTION OF THE PREFERRED EMBODIMENTS

Figure 1:
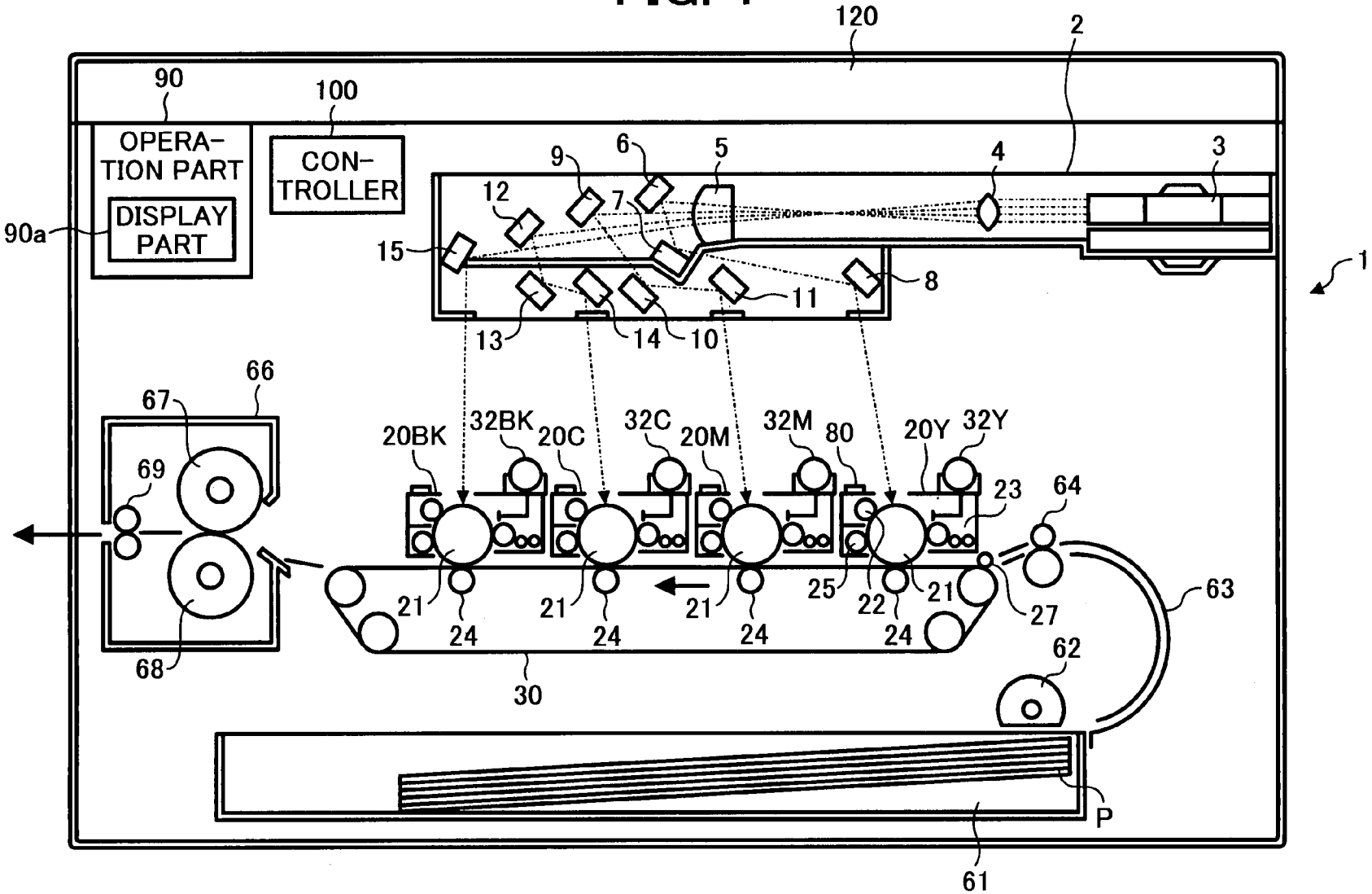
FIG. 1 is a schematic drawing of an image forming apparatus according to a preferred embodiment of the present invention.

Referring now to the drawings, wherein like reference numerals designate identical or corresponding parts throughout the several views, preferred embodiments of the present invention are described.

FIG. 1 illustrates an overall construction of an image forming apparatus according to a preferred embodiment of the present invention. Numeral 1 denotes a main body of a color copier as an example of the image forming apparatus, numeral 2 denotes an optical unit configured to emit a laser light according to image information, numeral symbols 20Y, 20M, 20C and 20BK denote process cartridges as replaceable units installed at positions corresponding to respective colors (yellow, magenta, cyan and black), respectively, numerals 21 denote photoconductor drums as image bearing members accommodated in the process cartridges 20Y, 20M, 20C and 20BK, respectively, numeral 22 denotes a charging unit configured to charge the surface of the photoconductor drum 21 in the process cartridge 20Y, numeral 23 denotes a development unit configured to develop an electrostatic latent image formed on the photoconductor drum 21 in the process cartridge 20Y, numerals 24 denote transfer rollers as transfer units configured to transfer toner images formed on the photoconductor drums 21 onto a transfer member P such as a transfer sheet, respectively, numeral 25 denotes a cleaning unit configured to remove and collect residual toner on the photoconductor drum 21 in the process cartridge 20Y. In FIG. 1, only the charging unit 22, the development unit 23 and the cleaning unit 25 for the photoconductor drum 21 accommodated in process cartridge 20Y are denoted by respective numerals. Numeral 30 denotes a transfer belt of a transfer belt unit, numeral symbols 32Y, 32M, 32C and 32BK denote toner supply units configured to supply toner of respective colors to the development units 23 of the process cartridges 20Y, 20M, 20C and 20BK, respectively, numeral 61 denotes a sheet feeding unit in which the transfer sheet P is accommodated, numeral 66 denotes a fixing unit configured to fix an unfixed toner image on the transfer sheet P onto the sheet P, and numeral 80 denotes an IC tag detachably attached to the process cartridge 20Y. In FIG. 1, the IC tags attached to the process cartridges 20M, 20C and 20BK are not denoted. Numeral 90 denotes an operation part using a touch panel, which is provided to an outer cover of the main body 1 to be partially exposed, numeral symbol 90*a* denotes a display part integrally provided to the operation part 90, numeral 100 denotes a controller of the main body 1, and numeral 120 denotes a scanner configured to optically read an original document placed on an original document placement platform.

Here, in each of the process cartridges 20Y, 20M, 20C and 20BK, the photoconductor drum 21, the charging unit 22, the development unit 23, and the cleaning unit 25 are integrally supported, and images of respective colors (yellow, magenta, cyan, black) are formed on respective photoconductor drums 21 in process cartridges 20Y, 20M, 20C and 20BK.

Now, an operation of the image forming apparatus when forming a color image is described.

The photoconductor drums 21 rotate in the clockwise direction in FIG. 1, respectively, and the surfaces of the photoconductor drums 21 are uniformly charged at the positions opposing the charging units 22, which process is called a charge process. Thereafter, the charged surfaces of the photoconductor drums 21 reach the positions where the surfaces of the photoconductor drums 21 are illuminated by laser light, respectively.

On the other hand, image information of a color original document placed on the original document placement platform of the scanner 120 is optically read with a reading unit (not shown). That is, the original document is scanned with an illuminating light emitted from a light source (not shown), and an image of the original document is imaged on a color CCD (not shown), and thereby the image of the original document, i.e., a reflected light from the original document, is photo-electrically converted to image signals of R, G, B with the color CCD. These image signals are transmitted to the optical unit 2. Thereafter, a laser light corresponding to each image signal is emitted, correspondingly to each color, from an LD light source of the optical unit 2. The laser light launches onto a polygon mirror 3 to be reflected, and thereafter passes lenses 4 and 5. The laser light after passing the lenses 4 and 5 travels through an optical path different from each other for each of yellow, magenta, cyan and black components. The above-described process is called an exposure process.

A laser light of the yellow component is illuminated onto a surface of the photoconductor drum 21 of the process cartridge 20Y after having been reflected by mirrors 6, 7 and 8. At this time, the laser light of the yellow component is caused to scan in a direction of a rotation axis of the photoconductor drum 21 (the main scanning direction) with the polygon mirror 3 rotating at a high speed. Thereby, an electrostatic latent image of the yellow component is formed on the surface of the photoconductor drum 21 charged with the charging unit 22.

Similarly, a laser light of the magenta component is illuminated onto a surface of the photoconductor drum 21 of the process cartridge 20M after having been reflected by mirrors 9, 10 and 11, and an electrostatic latent image of the magenta component is formed on the surface of the photoconductor drum 21 of the process cartridge 20M. A laser light of the cyan component is illuminated onto a surface of the photoconductor drum 21 of the process cartridge 20C after having been reflected by mirrors 12, 13 and 14, and an electrostatic latent image of the cyan component is formed on the photoconductor drum 21 of the process cartridge 20C. A laser light of the black component is illuminated onto a surface of the photoconductor drum 21 of the process cartridge 20BK after having been reflected by a mirror 15, and an electrostatic latent image of the black component is formed on the photoconductor drum 21 of the process cartridge 20BK.

Thereafter, the surfaces of the photoconductor drums 21 on which the electrostatic latent images of respective colors have been formed reach the positions opposing the development units 23. Toners of respective colors are provided to the surfaces of the respective photoconductor drums 21 from the development units 23, so that the electrostatic latent images on the photoconductor drums 21 are developed into toner images of respective colors. The above-described process is called a development process.

The surfaces of the photoconductor drums 21 thereafter reach the positions opposing the transfer belt 30. The transfer rollers 24 are arranged so as to contact the internal circumferential surface of the transfer belt 30 at positions where the photoconductor drums 21 oppose the transfer belt 30. The toner images of respective colors formed on the respective photoconductor drums 21 are sequentially transferred onto a transfer sheet P being conveyed by the transfer belt 30 at the positions of the respective transfer rollers 24, so as to be superimposed on top of each other, and thereby a full color image is formed on the transfer sheet P. The above-described process is called a transfer process.

The transfer belt 30 is spanned around and supported by a drive roller and three driven rollers in the transfer belt unit. The transfer belt 30 is driven by the drive roller to travel in the arrow direction in FIG. 1. The transfer rollers 24, the transfer belt 30, etc. are integrated with each other in the transfer belt unit, so that the transfer belt unit is configured as a unit replaceable relative to the main body 1.

The surfaces of the photoconductor drums 21 after transferring the toner images reach the positions opposing the cleaning units 25, respectively. Residual toner remaining on the surfaces of the photoconductor drums 21 are collected with the respective cleaning units 25 which is called a cleaning process.

Thereafter, the surfaces of the photoconductor drums 21 pass discharging units (not shown), and thereby a series of image forming processes end.

On the other hand, the transfer sheet P fed from the sheet feeding unit 61 by a feeding roller 62 passes a conveying guide 63 to be guided to the position of a registration roller 64. The transfer sheet P guided to the registration roller 64 is conveyed, while being controlled in a conveying timing, toward a contact part of the transfer belt 30 and a sticking roller 27.

Thereafter, the transfer sheet P sequentially passes the positions where the transfer belt 30 opposes the photoconductor drums 21, while being conveyed by the transfer belt 31 traveling in the arrow direction in FIG. 1. Thereby, the toner images of respective colors on the photoconductor drums 21 are transferred onto the transfer sheet P while being superimposed on top of each other, so that a full color image is formed on the transfer sheet P.

The transfer sheet P on which the full color image has been formed separates from the transfer belt 30 to be guided to the fixing unit 66. At the fixing unit 66, the color image is fixed onto the transfer sheet P at a nip part of a heating roller 67 and a pressure roller 68.

The transfer sheet P after the color image has been fixed thereto is discharged from the main body 1 by a discharge roller 69, and thereby a series of operations of the image forming apparatus end.

Figure 2A:
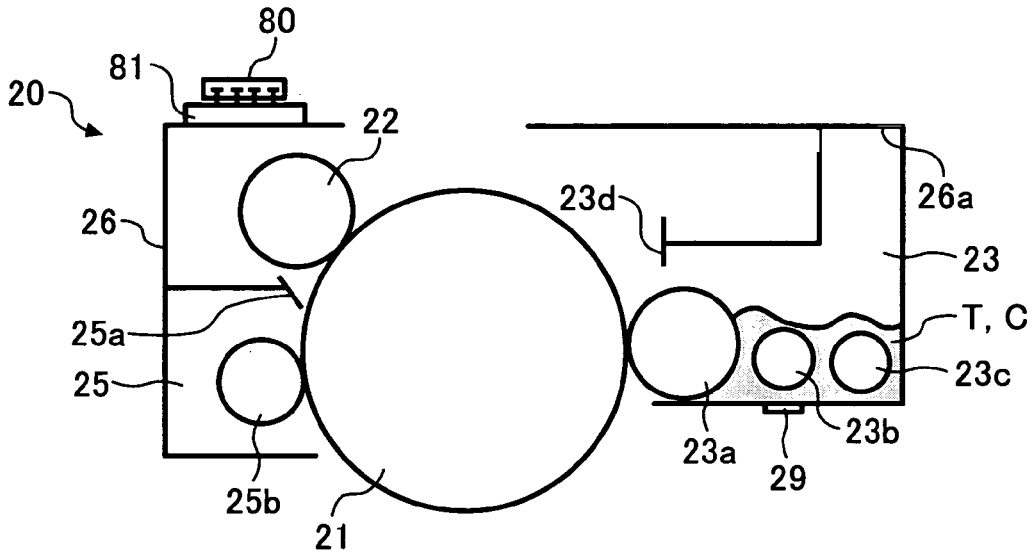
FIG. 2A is a cross section of a process cartridge, which is installed in a replaceable manner in the image forming apparatus of FIG. 1.
Figure 2B:
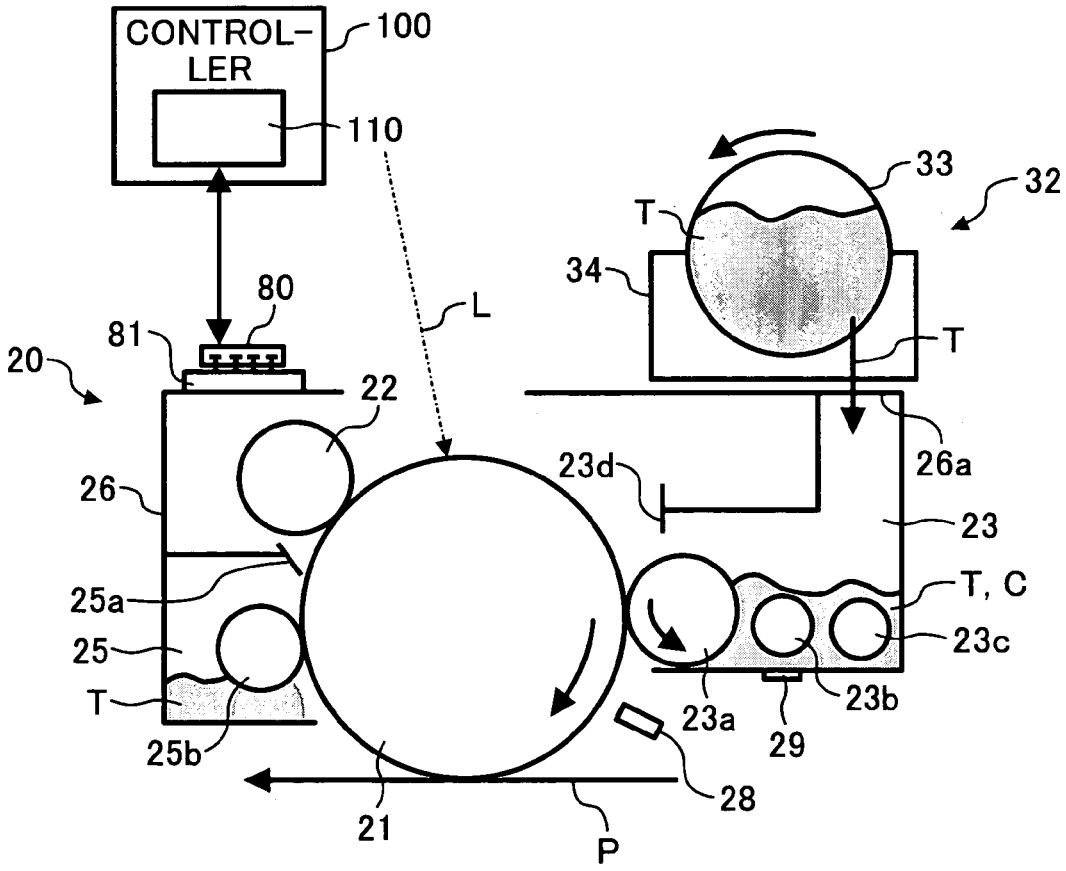
FIG. 2B is a cross section of the process cartridge installed in the image forming apparatus.

Now, referring to FIG. 2A and FIG. 2B, the process cartridges 20Y, 20M, 20C and 20BK, which are installed in the main body 1 of the image forming apparatus in a freely replaceable manner, are described.

The process cartridges 20Y, 20M, 20C and 20BK installed in the main body 1 are substantially the same in their configurations except that colors of accommodated toner T are different from each other. Therefore, in FIG. 2A and FIG. 2B, the process cartridge is denoted by numeral 20 without the letters Y, M, C and BK.

FIG. 2A illustrates the process cartridge 20 in mint condition. That is, the process cartridge 20 is a new process cartridge or a recycled process cartridge that has never been used in an image forming apparatus after having been manufactured at a factory or processed for recycling.

As illustrated in FIG. 2A, the photoconductor drum 21 serving as the image bearing member, the charging unit 22, the development unit 23, and the cleaning unit 25 are integrally accommodated in a case 26 of the process cartridge 20. The development unit 23 includes a development roller 23*a*, stirring rollers 23*b* and 23*c*, a doctor blade 23*d*, a toner density sensor (T sensor) 29, etc., and a developer including carriers C and toner T are accommodated therein. The cleaning unit 25 includes a cleaning blade 25*a*, a cleaning roller 25*b*, etc.

Here, the IC tag 80 is detachably mounted on the case 26 of the process cartridge 20.

Specifically, the IC tag 80 is an IC (integrated circuit) capable of communicating with the controller 100 of the main body 1, and is a packaged IC having an external terminal. The external terminal of the IC tag 80 is inserted in a connection terminal of an IC socket 81 fixed to the case 26. Thereby, when the process cartridge 20 is malfunctioning, the IC tag 80 can be easily replaced, and the recycling process of cartridge 20 is relatively easy.

The IC tag 80 may be configured otherwise than as described herein. For example, the IC tag 80 may be configured with an IC chip of about several millimeters square in size, or may be configured such that an IC chip is mounted on a PCB having an external terminal. Further, the IC tag 80 may be configured as a contact type IC tag to perform wired communication with the controller 100 of the main body 1 or a non-contact type IC tag to perform wireless communication with the controller 100.

A service person performs a replacement operation of the process cartridge 20 relative to the main body 1 using process cartridge 20 as a replacement unit.

Referring to FIG. 2B, process cartridge 20 is used as a replacement unit installed at an installation part of the main body 1. More specifically, after opening a door (not shown) of the main body 1, process cartridge 20 is guided by a rail (not shown) provided in the main body 1 to be installed in the main body 1.

After the process cartridge 20 has been installed in the main body 1, comparison of information is performed between the IC tag 80 of the process cartridge 20 and an engine control board 110 of the controller 100 in the main body 1. At this time, recognition information of the process cartridge 20 stored in a first non-volatile memory installed in the IC tag 80 and a plurality of second recognition information stored in a second non-volatile memory installed in the engine control board 110 are compared with each other. The control of such comparison is described later.

After the above-described comparison of information has been completed, adjustment of the image forming apparatus based on control information or exchange of information with an administration system (described later) is performed as necessary, and thereafter a regular image forming operation is performed. The regular image forming operation is performed as described above with reference to FIG. 1.

Specifically, the development roller 23*a* rotates in the arrow direction in FIG. 2B. The toner T in the development unit 23 is mixed, together with the toner T supplied from the toner supply unit 32, with the carrier C by the stirring rollers 23*b* and 23*c* rotating in the counterclockwise direction in FIG. 2B. The toner T charged by friction is supplied onto the development roller 23*a* together with the carriers C by the stirring roller 23*b*.

Toner T accommodated in the toner bottle 33 is supplied to the development unit 23 accordingly as the toner T in the development unit 23 is consumed. Consumption of the toner T in the development unit 23 is detected by a toner density sensor (P sensor) 28 as an optical sensor opposing the photoconductor drum 21 and the toner density sensor (T sensor) 29 as a permeability sensor arranged in the development unit 23.

Thereafter, the toner T born on the development roller 23*a* reaches, after passing the position of the doctor blade 23*d*, the position where the development roller 23*a* opposes the photoconductor drum 21, where the toner T is caused to adhere to an electrostatic latent image formed on a surface of the photoconductor drum 21. More specifically, the toner T adheres to the surface of the photoconductor drum 21 by an electric field formed by a potential difference between a surface potential of an area of the photoconductor drum 21 illuminated by a laser light L and a development bias applied to the development roller 23*a*.

The toner T adhered to the photoconductor drum 21 is mostly transferred onto a transfer sheet P. Residual toner T on the photoconductor drum 21 is collected into the cleaning unit 25 by the cleaning blade 25*a* and the cleaning roller 25*b*.

Figure 3:
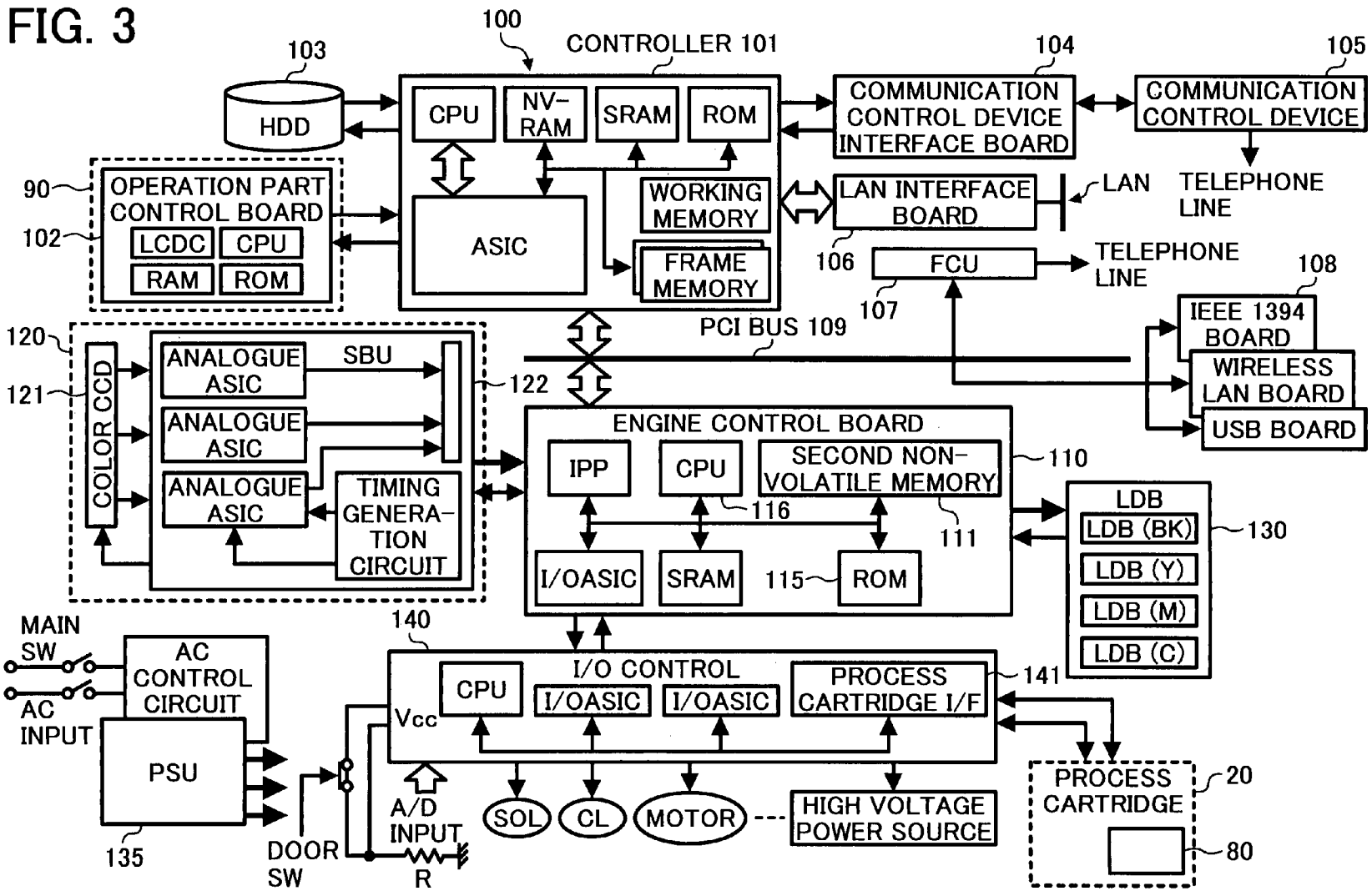
FIG. 3 is a block diagram of a controller of the image forming apparatus.

Next, referring to FIG. 3, the controller 100 of the main body 1 and the IC tag 80 of the process cartridge 20 are described.

As illustrated in FIG. 3, the controller 100 includes a controller board 101 configured to control the entire image forming apparatus, an operation part control board 102 configured to perform control concerning the operation part 90, an HDD 103 to store image information, a communication control device interface board 104 connected with a public communication line such as an analogue telephone line via a communication control device 105, a LAN interface board 106 connected with a LAN, a facsimile control unit (FCU) 107 connected with a PCI bus 109, an IEEE1394 board/wireless LAN board/USB board 108, the engine control board 110 connected with the controller board 101 via the PCI bus 109, an I/O control board 140 connected with the engine control board 110 and configured to control an I/O of the main body 1, a scanner board (SBU) 122 configured to read an original document placed on the original document placement platform of the scanner 120, and an LD board (LDB) 130 configured to write image information on the surfaces of the photoconductor drums 21 with a laser light.

A color CCD 121 of the scanner 120 is a three-line color CCD, and generates R, G, B image signals of EVENch/ODDch. The image signals are inputted to analogue ASICs of the scanner board (SBU) 122. The SBU 122 includes a timing generation circuit to generate drive timings for the analogue ASICs and the color CCD 121. Outputs of the color CCD 121 are processed with analogue-to-digital conversion after having been sampled at sample-and-hold circuits in the analogue ASICs. Thereafter, R, G, B image data is processed with shading correction, and is outputted to an image information processor (IPP) of the engine control board 110 via an output I/F.

At the IPP of the engine control board 110, various kinds of image processing are performed, such as area determination (determining whether an area is a character area or a photograph area), removal of background, scanner gamma conversion, filtering, color correction, enlargement and reduction, image editing, printer gamma conversion, gradation processing, etc. The IPP is a programmable calculation device to perform image processing.

The image information transmitted to the IPP from the SBU 122 is stored in a frame memory of the controller board 101 after having been processed with correction of signal deterioration.

The controller board 101 includes a CPU, a ROM configured to control the controller board 101, an SRAM serving as a working memory used by the CPU, an NV-RAM including a lithium battery to backup the SRAM and a clock, an ASIC configured to control surroundings of the CPU, such as system bus control, frame memory control, FIFO, etc., and an interface circuit.

The controller board 101 performs various applications of the image forming apparatus as a multi-function apparatus, such as a scanner application, a facsimile application, a printer application, a copier application, etc., and is configured to control the entire image forming apparatus. Specifically, the controller board 101 recognizes information concerning an application inputted from the operation part control board 102 and sets a system configuration, and at the same time displays the condition of the system configuration in the display part 90*a* of the operation part 90.

The controller board 101 is connected with the communication control device 105, via the communication control device interface board 104, so as to be capable of full-duplex asynchronous serial communication. The communication control device 105 is connected with the telephone line in a multi-drop connection according to the RS-485 interface standard, and performs communication with the administration system (described later) via the communication control interface board 104.

The controller board 101 is connected with the LAN (Internet) via the LAN interface board 106. The LAN interface board 106 is a standard communication interface, such as a PHY chip I/F mounting a PHY chip and an I2C bus I/F. The controller board 101 communicates with the administration system via the LAN interface board 106.

The HDD 103 connected with the controller board 101 functions as an application database storing system application programs and additional information and a database concerning image information. The HDD 103 is connected with the controller board 101 via an interface based on ATA/ATAPI-4.

The operation part control board 102 connected with the controller board 101 includes a CPU, a ROM, a RAM, an LCDC, etc. Key inputting is performed at the operation part 90 and displaying of information necessary for operation is performed at the display part 90*a* by communication between the operation part control board 102 and the controller board 101. That is, the inputting of system settings by the service person is performed at the operation part 90, and informing the service person of the contents of system settings and the system conditions is performed by the display part 90*a*. A control program for controlling the acceptance of key inputting and the output display information is stored in the ROM of the operation part control board 102. The RAM in the operation part control board 102 is a working memory of the CPU.

The engine control board 110 mainly performs control of the image forming operation described with reference to FIG. 1, FIG. 2A and FIG. 2B. The engine control board 110 includes a CPU 116, an I/OASIC, an IPP, a ROM 115 holding programs necessary for the control of the image forming operation, an SRAM necessary for the control of the image forming operation, and a second non-volatile memory 111, etc.

The second non-volatile memory 111 is an IC connected with a bus of the CPU 116, is capable of communicating with the CPU 116 via the bus, and is a packaged EEPROM having an external terminal. The external terminal of the second non-volatile memory 111 is inserted in a connection terminal of an IC socket (not shown) fixed to the engine control board 110. Thereby, when the engine control board 110 is malfunctioning, the second non-volatile memory 111 can be easily replaced, and in recycling the engine control board 110, the recycling process of the second non-volatile memory 111 is relatively easy. Further, by using serial communication between CPU 116 of the controller 100 and the first non-volatile memory installed in the IC tag 80, the number of connection pins is decreased, and the attaching and detaching operation of the second non-volatile memory 111 is facilitated.

The second non-volatile memory 111 is not limited to an EEPROM as in this embodiment. For example, various memories, e.g., a RAM, in which power supply is backed up, may be used for the second non-volatile memory 111.

The engine control board 110 is connected with the controller board 101 via the PCI bus 109. The PCI bus 109 is an image information/control command bus transferring image information and control commands by time-sharing.

At the LDB 130 connected with the engine control board 110, writing signals for respective colors (yellow, magenta, cyan, black) outputted from the working memory of the controller board 101 are inputted to LD writing circuits. LD electric current control (modulation control) is performed at the LD writing circuits, and the writing signals are outputted to respective LD light sources.

The I/OASIC of the engine control board 110 includes a serial interface performing transmission and receipt of signals with the CPU 116. The I/OASIC controls various devices mounted in the vicinity of the engine control board 110, such as a counter, a fan, a solenoid, a motor, etc.

The I/O control board 140 connected with the engine control board 110 by a synchronous serial interface includes a CPU, I/OASICs, a process cartridge I/F 141, etc. The CPU of the I/O control board 140 functions as a sub-CPU, and performs I/O control such as control of the toner density sensors 28 and 29 described with reference to FIG. 2A and FIG. 2B.

Detection of installment of the process cartridge 20 in mint condition to the main body 1 is performed when a door of the main body 1 has been opened and closed. That is, when a door switch SW connected with the I/O control board 140 is turned off, there is a possibility that the process cartridge 20 has been replaced, so a determination as to if the process cartridge 20 has been replaced is performed and the result of the determination is output to the engine control board 110.

The process cartridge I/O 141 is an interface circuit enabling transmission and receipt of information between the second non-volatile memory 111 of the engine control board 110 of the main body 1 and the first non-volatile memory of the IC tag 80 mounted to the process cartridge 20.

The communication interface between the first non-volatile memory of the IC tag 80 and the controller 100 of the main body 1 can be an I2C bus. In this case, a parallel signal from the CPU 116 of the controller 100 is converted to an I2C signal to be transmitted to the first non-volatile memory of the IC tag 80. Similarly, a signal from the first non-volatile memory is converted to a parallel signal to be transmitted to the CPU 116 of the controller 100. Further, an I2C bus may be provided to the CPU 116 of the controller 100 to directly connect the first non-volatile memory of the IC tag 80 with the CPU 116.

A PSU 135 is a unit configured to supply power to the main body 1. By turning on the main switch SW of the main body 1, commercial power is supplied to the image forming apparatus.

Figure 4:
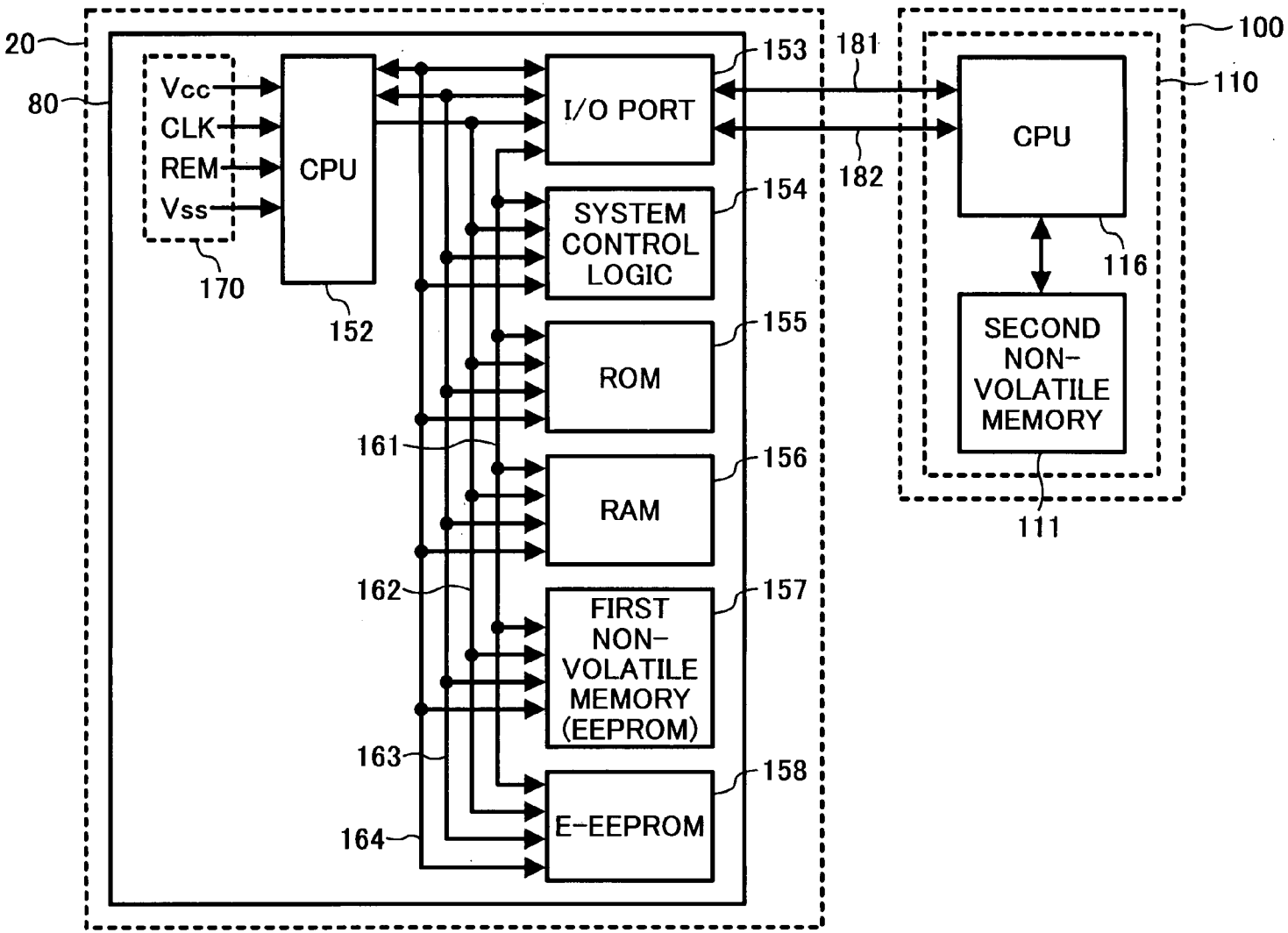
FIG. 4 is a block diagram of an IC tag installed to the process cartridge.

Now, referring to FIG. 4, the IC tag 80, which is detachably mounted to the process cartridge 20, is described.

As illustrated in FIG. 4, the IC tag 80 is a contact-type IC tag, and includes a CPU 152, an I/O port 153, a system control logic 154, a ROM 155, a RAM 156, an EEPROM 157 as the first non-volatile memory, and an E-EEPROM 158.

Here, recognition information and control information of the process cartridge 20 are held in the first non-volatile memory (EEPROM) 157.

The recognition information held in the first non-volatile memory 157 is information, such as identification codes, for identifying the type of the process cartridge 20 (manufacturer, whether or not it has been processed for recycling before, the number of times of having been processed for recycling, version, color, etc.)

The control information stored in the first non-volatile memory 157 is information concerning the process cartridge 20, which is necessary for controlling the image forming apparatus in which the process cartridge 20 is installed, and corresponds to the recognition information of the process cartridge 20.

For example, the following information is stored in the first non-volatile memory 157 as the control information; information concerning image forming conditions such as an exposure amount, a charge amount, a development bias, a manufacture lot number, a manufacture date, a color ID, a storage period of time, a usage start date, an accumulated number of copies provided, the number of times recycled, an upper limit of the number of times recycled, a schedule of replacing components, a lot number of toner, a recycled date, a filling amount, a filled date, an amount of remaining toner, T sensor control information, and P sensor control information.

The image forming conditions concern the image forming processes described with reference to FIG. 1, FIG. 2A and FIG. 2B, such as the exposure amount of a laser light L in the exposure process, the charge amount of the charging unit 22 in the charge process, the development bias of the development unit 23 in the development process, etc., and are information peculiar to the process cartridge 20 for performing an optimum image forming operation with the process cartridge 20.

The CPU 152 performs writing information to the first non-volatile memory 157 and reading information stored in the first non-volatile memory 157, in response to communication with and instructions from the outside, by a program stored therein.

The I/O port 153 is a communication interface based on an ISO7816-3 standard, and performs transmission and receipt of communication interface signals 181 and 182 with the second non-volatile memory 111 via the CPU 116 of the engine control board 116. The CPU 152 can also transmit and receive an interface signal 170 to and from the CPUs of the main body 1 other than the CPU 116 of the engine control board 110.

The system control logic 154 is a control circuit performing control within the IC tag 80. The ROM 155 is a program memory that stores a program, and the RAM 156 is a working memory for executing the stored program. The E-EEPROM 158 is a memory storing a program dedicated for writing information to the first non-volatile memory 157.

The CPU 152, the I/O port 153, the system control logic 154, the ROM 155, the RAM 156, the first non-volatile memory 157, and the E-EEPROM 158 are connected with each other by control signal 161, control bus 162, data bus 163, and address bus 164.

In this embodiment, the IC tag 80 is configured as a contact type IC tag. However, the IC tag can be configured as a non-contact type IC tag. In this case, a non-contact communication interface connected with a transmitting and receiving antenna is provided instead of the I/O port 153 in FIG. 4, and a power supply is arranged. Information is transmitted and received by wireless communication between the IC tag 80 and the CPUs at the side of the main body 1.

The non-volatile memory 157 of the IC tag 80 is not limited to an EEPROM, and can be a non-volatile memory of various types.

The second non-volatile memory 111 of the controller 100 in the main body 1 holds a plurality of second recognition information, a plurality of control information corresponding to the plurality of second recognition information, and supplement control information supplementing the plurality of control information.

The second recognition information held in the second non-volatile memory 111 is information, such as recognition codes, etc., for identifying the type of process cartridge 20 installed in the main body 1. The second non-volatile memory 111 holds the plurality of second recognition information corresponding to a plurality of process cartridges that might be installed in the main body 1.

The plurality of control information held in the second non-volatile memory 111 is information concerning the process cartridge 20 necessary for controlling an image forming apparatus and corresponding to the plurality of second recognition information. The control information includes information concerning the image forming conditions described above.

Even when control information, perfectly according with the control condition of a process cartridge as a control target, does not exist in the plurality of control information held in the second non-volatile memory 111, there is a possibility that resembling control information (compatible control information, i.e., control information compatible to the control condition of the target process cartridge) exists in the plurality of control information.

The supplement control information held in the second non-volatile memory 111 is information concerning the process cartridge 20 necessary for controlling the image forming apparatus in an optimum manner to cope with a case where a different type of process cartridge 20 not assumed to be installed in the main body 1 has been installed in the main body 1. Here, the supplement control information includes standard supplement control information and current control information (i.e., control information before replacement).

The standard supplement control information is information concerning a control condition in which all process cartridge control conditions are not customized but instead averaged.

The control information before replacement is information concerning a previous process cartridge control condition before the process cartridge 20 was replaced, and is control information that was used for controlling an image forming operation until comparison of the recognition information and the second recognition information is performed, which is described later.

Thus, regardless of the type of the process cartridge 20 installed in the main body 1, control information according with the control condition of the process cartridge 20 or control information optimum for the process cartridge 20 is selected from the control information and supplement control information held in the second non-volatile memory 111, so that the image forming apparatus is adjusted and controlled based on the selected control information.

Next, control in the above-described image forming apparatus is described with reference to FIG. 5 through FIG. 8.

Figures 5, 5A:
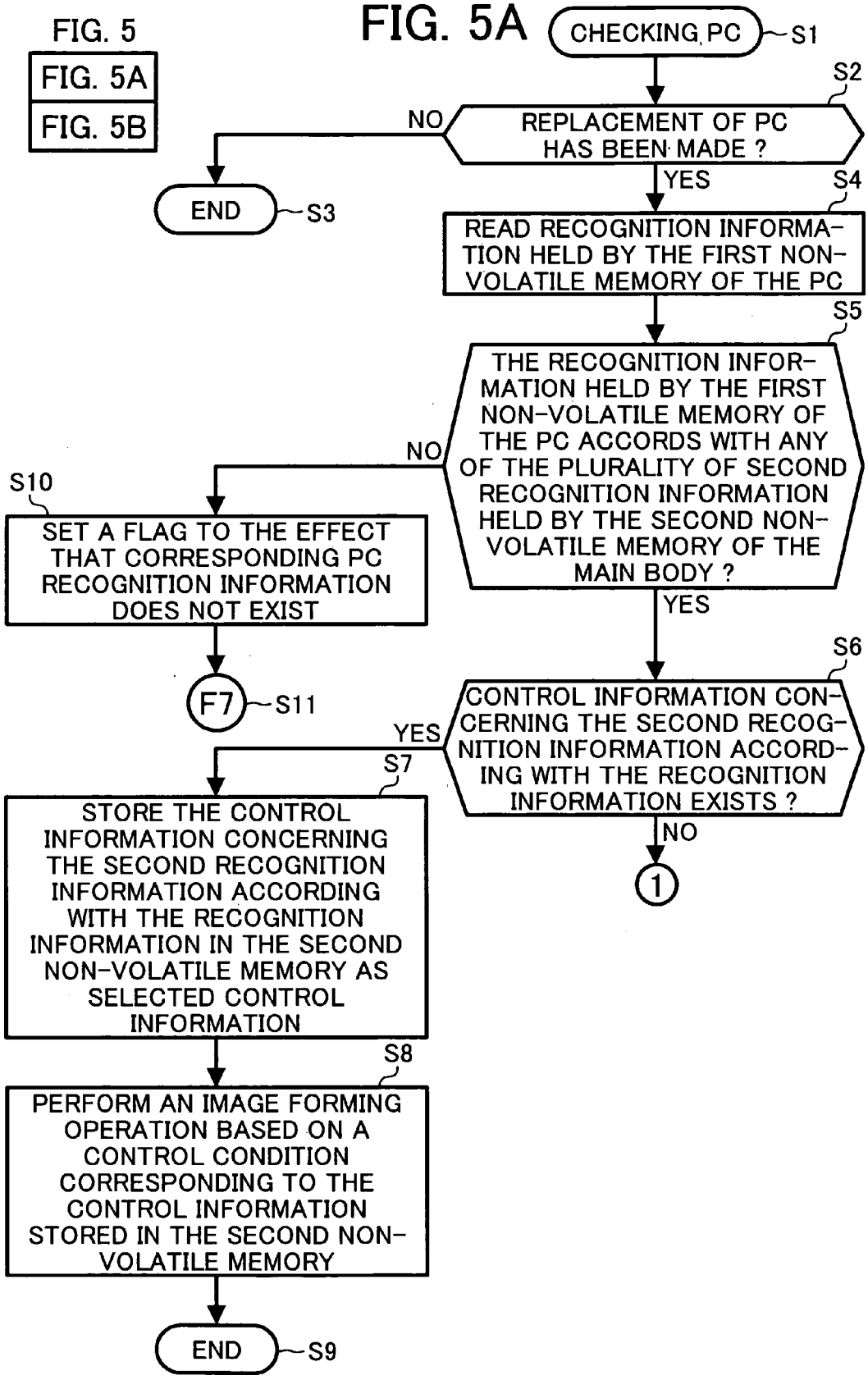
FIGS. 5A-5B are flowcharts of a control process of the image forming apparatus when the process cartridge is installed in the main body.
Figure 5B:
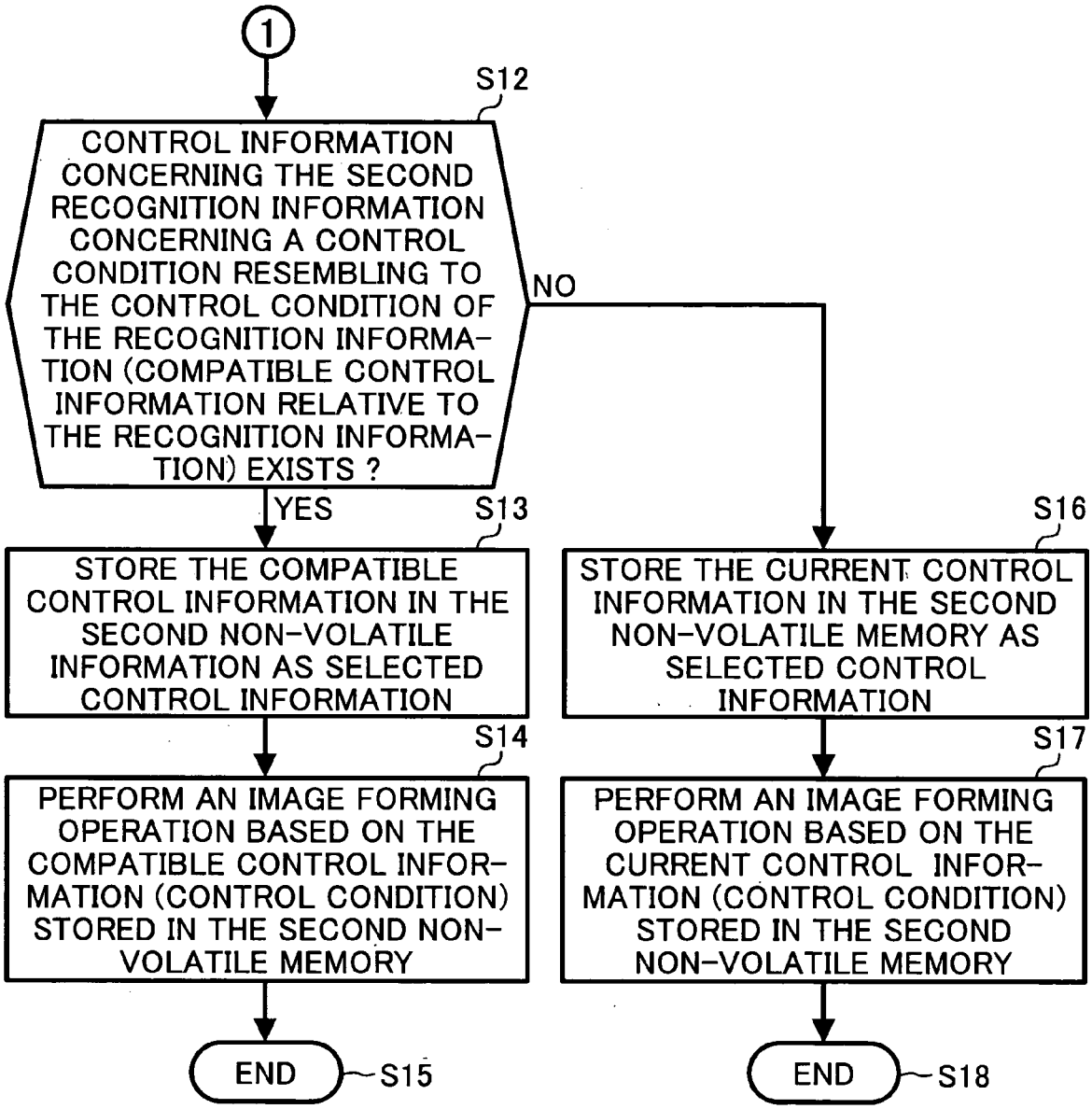

FIG. 5 is a flowchart of a control process of the image forming apparatus when the process cartridge 20 is installed in the main body 1.

First, a checking process for checking the process cartridge 20 (described as "PC" in flowcharts) is performed and it is determined if the process cartridge 20 in the main body 1 has been replaced (step S1 and step S2). Details of the checking process are described later with reference to FIG. 6.

When it has been determined that the process cartridge 20 was not replaced, the control process ends (step S3).

When it has been determined in step S3 that the process cartridge 20 has been replaced, the recognition information held in the first non-volatile memory 157 of the process cartridge 20 is read at the controller 100 (step S4).

Then, the recognition information held in the first non-volatile memory 157 of the process cartridge 20 and the plurality of second recognition information held in the second non-volatile memory 111 of the main body 1 are compared with each other (step S5).

When it has been determined that the recognition information held in the first non-volatile memory 157 does not correspond to (i.e., doest not accord with or resemble to) any of the plurality of second recognition information held in the second non-volatile memory 111, a flag that recognition information corresponding to the process cartridge 20 does not exist (i.e., corresponding PC recognition information does not exist) in the main body 1 is set in the working memory of the controller 100 (step S10). Then, the control process ends, and moves to another process F7 illustrated in FIG. 7 (step S11).

When it has been determined in step S5 that the recognition information held in the first non-volatile memory 157 corresponds to at least one of the plurality of second recognition information held in the second non-volatile memory 111, it is further determined if control information concerning the second recognition information according with the recognition information exists (step S6).

When it has been determined that the control information concerning the second recognition information according with the recognition information exists, the control information concerning the second recognition information according with the recognition information is stored in the second non-volatile memory 111 as the selected control information (step S7).

Figures 8, 8A:
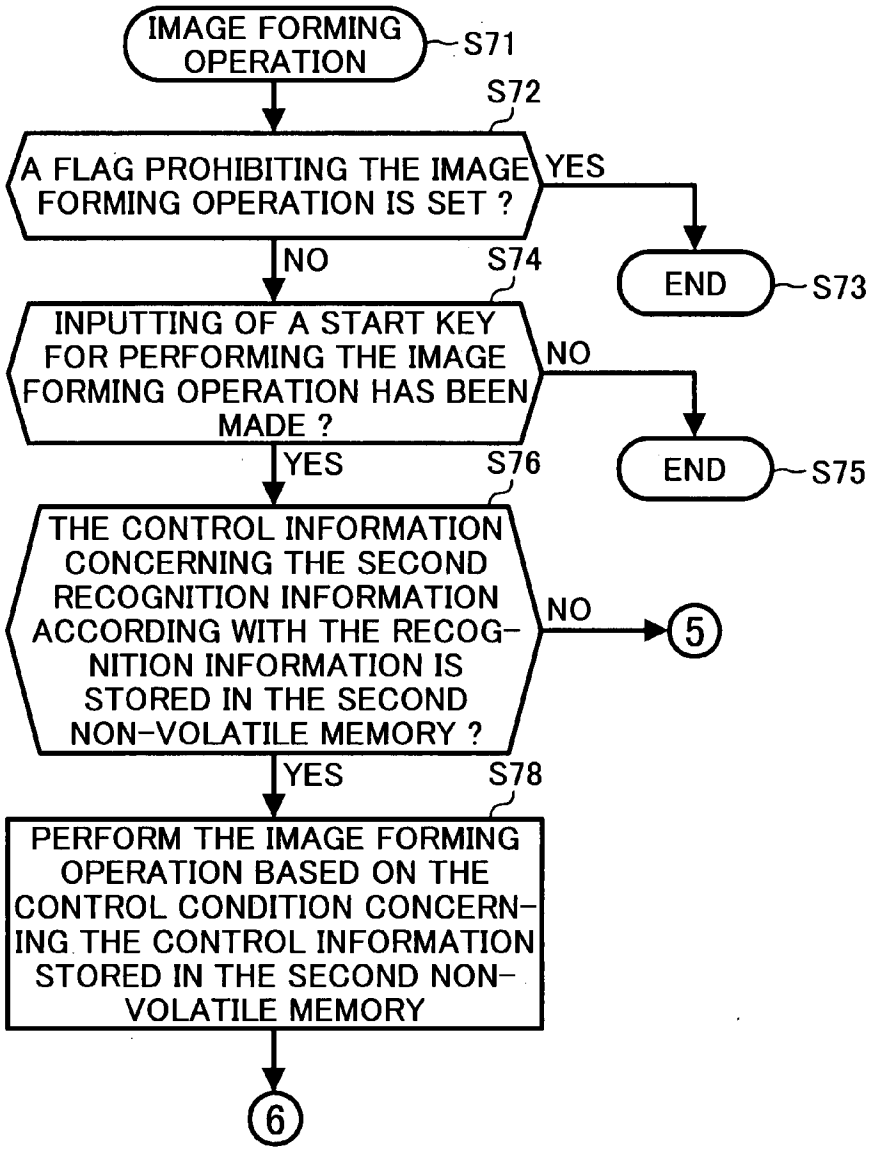
FIGS. 8A-8B are flowcharts of a control process concerning an image forming operation.
Figure 8B:
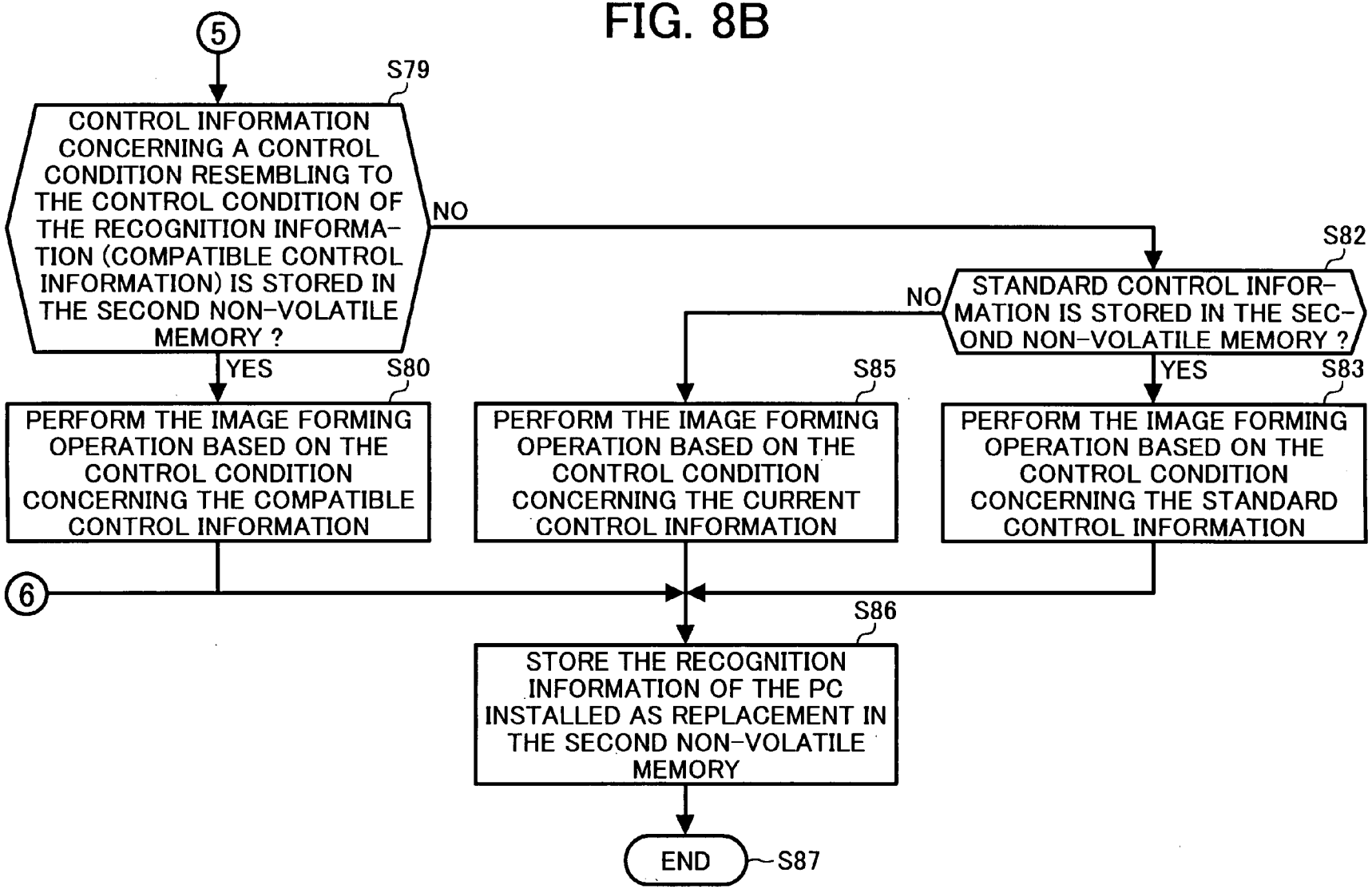

Thereafter, after going through an image forming process illustrated in FIG. 8, the image forming apparatus is adjusted and controlled to perform an image forming operation based on a control condition corresponding to the control information stored in the second non-volatile memory 111 (step S8). At this point, the image forming apparatus operates based on the control condition perfectly according with the control condition of the process cartridge 20 installed as a replacement.

The control process then ends (step S9).

When it has been determined in step S6 that the control information concerning the second recognition information according with the recognition information does not exist, it is further determined if control information concerning the second recognition information concerning a control condition resembling to the control condition of the recognition information (i.e., compatible control information relative to the recognition information) exists (step S12).

When it has been determined in step S12 that compatible control information relative to the recognition information exists, the compatible control information is stored in the second non-volatile information 111 as the selected control information (step S13).

Thereafter, after going thorough the image forming process of FIG. 8, an image forming operation is performed based on the compatible control information (control condition) stored in the second non-volatile memory 111 (S14). At this time, the image forming apparatus operates based on the control condition that does not perfectly accord with but highly resembles to the control condition of the process cartridge 20 installed as a replacement.

The control process then ends (step S15).

When it has been determined in step S12 that compatible control information relative to the recognition information does not exist, after going through the image forming process of FIG. 8, the current control information is stored in the second non-volatile memory 111 as selected control information (step S16). Here, the current control information is the control information used in image forming operations before making a comparison between the recognition information held in the first non-volatile memory 157 and the plurality of second recognition information held in the second non-volatile memory 111.

Thereafter, an image forming operation is performed based on the current control information (control condition) stored in the second non-volatile memory 111 (step S17). At this time, the image forming apparatus operates based on a previous control condition although it does not accord with the control condition of the process cartridge 20 installed as a replacement.

Then, the control process ends (step S18).

Figure 6A:
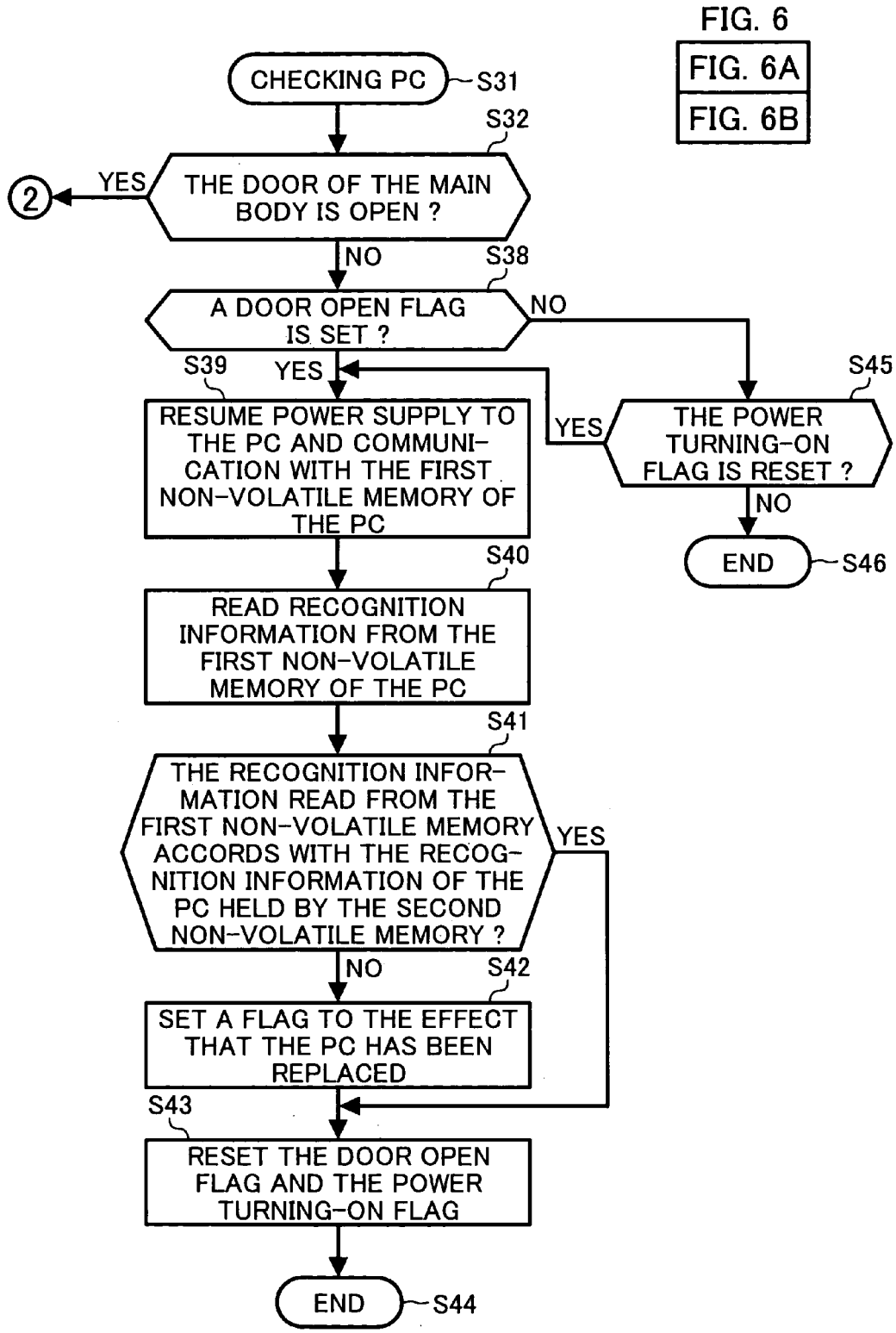
FIGS. 6A-6B are flowcharts of a control process concerning determination as to whether or not the process cartridge has been replaced.
Figure 6B:
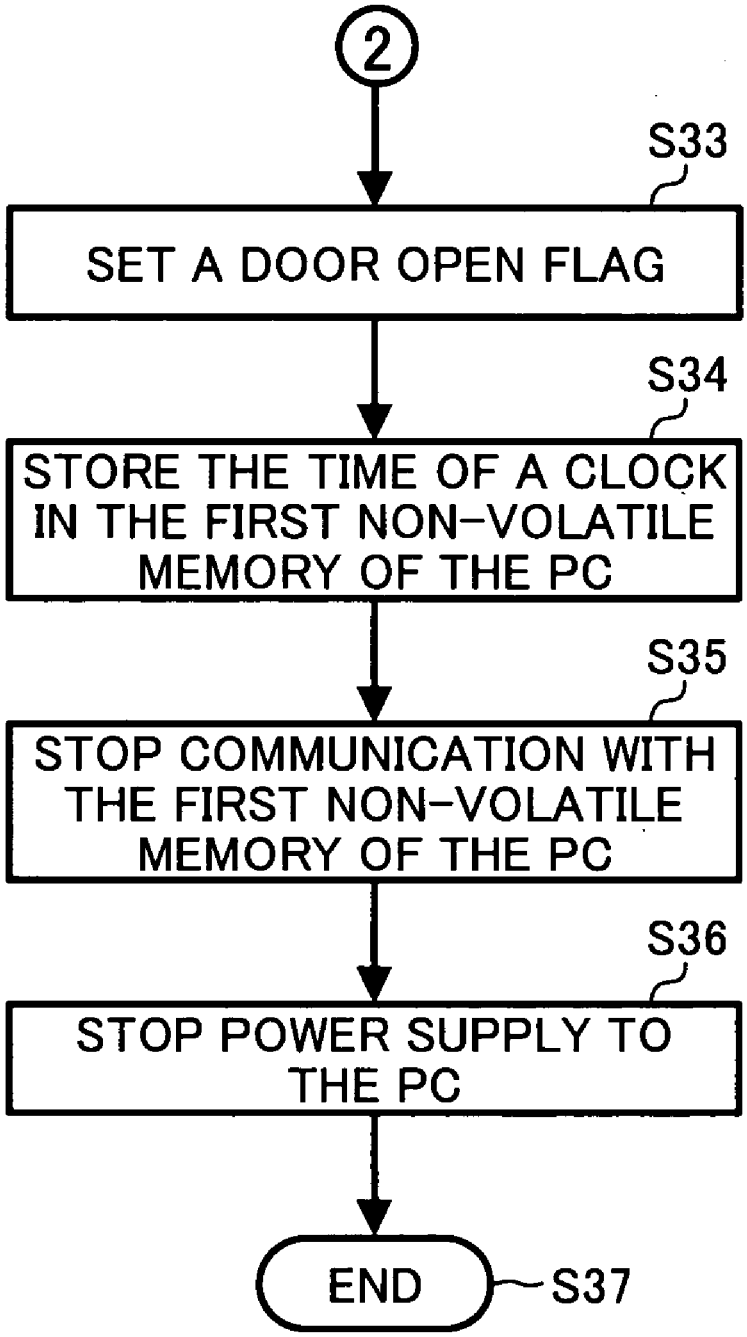

FIG. 6 is a flowchart of a control process concerning the determination as to whether or not the process cartridge 20 has been replaced. Here, control concerning the checking process concerning the determination as to whether or not the process cartridge 20 has been replaced, described with reference to step S2 of FIG. 5, is described more in detail.

First, it is determined if the door of the main body 1 is open (step S31 and step S32).

When it has been determined that the door is open, a door open flag is set (step S33).

Then, the time of a clock installed in the controller 100 of the main body 1 is stored in the first non-volatile memory 157 of the process cartridge 20 (step S34). Further, communication between the controller 100 and the first non-volatile memory 157 is stopped (step S35), power supply to the process cartridge 20 is stopped (step S36), and the control process ends (step S37).

When it has been determined in step S32 that the door is closed, it is determined if a door open flag is set (step S38) When it has been determined that the door open flag is set, i.e., when it has been determined as that the door has been opened and closed, the power supply to the process cartridge 20 is resumed and at the same time, communication between the controller 100 and the first non-volatile memory 157 is resumed (step S39). Then, the recognition information is read from the first non-volatile memory 157 of the process cartridge 20 (step S40).

Next, the recognition information read from the first non-volatile memory 157 in step S40 is compared with the recognition information (different from the second recognition information) of the process cartridge 20 held in the second non-volatile memory 111 (step S41).

When the recognition information held in the first non-volatile memory 157 does not accord with the recognition information held in the second non-volatile memory 111, it is determined that the process cartridge 20 has been replaced, and a flag to that effect is set (step S42). Thereafter, the door open flag and a power turning-on flag are reset (step S43), and the control process ends (step S44).

Here, the power turning-on flag is a flag set in the initial routine when the main switch (power switch) in FIG. 3 has been turned on.

When the recognition information held in the first non-volatile memory 157 accords with the recognition information held in the second non-volatile memory 111 in step S41, it is determined that the process cartridge 20 has not been replaced, and step S42 is skipped, and the control process proceeds to step S43 and ends (step S44).

When it has been determined in step S38 that the door open flag is not set, it is determined if the power turning-on flag is reset (step S45). When it has been determined that the power turning-on flag is not reset, i.e., the power is supplied, and the control process ends (step S46).

When it has been determined as that the power turning-on flag is reset, the control process ends (step S44) after going through the processes of step S39.

As illustrated in FIG. 5 and FIG. 6 and described above, comparison of the recognition information held in the first non-volatile memory 157 with the recognition information held in the second non-volatile memory 111 is performed only when the process cartridge 20 has been replaced. Thereby, the control of the image forming apparatus is simplified.

Figures 7, 7A:
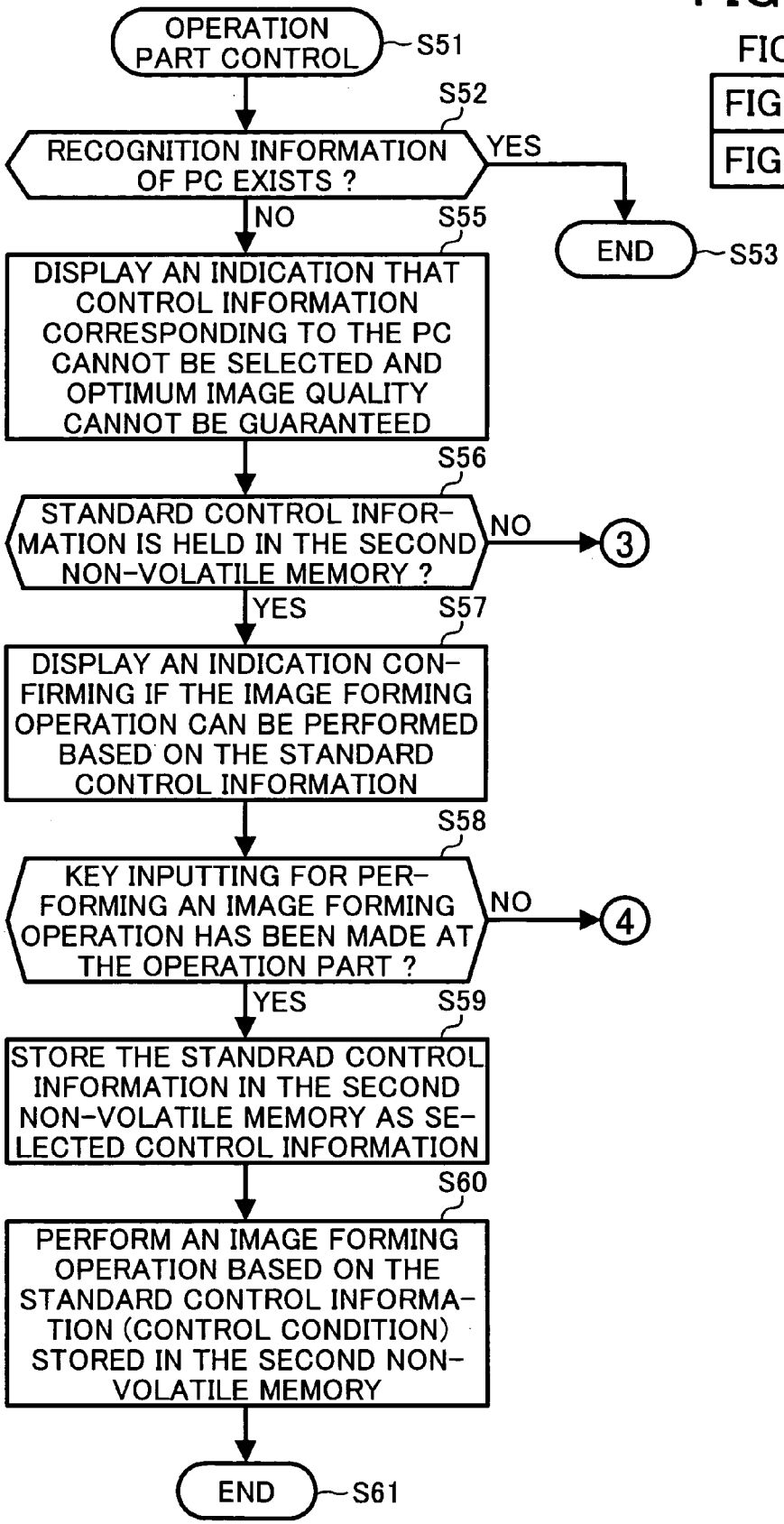
FIGS. 7A-7B are flowcharts of a control process in an operation part of the image forming apparatus, following FIG. 5.
Figure 7B:
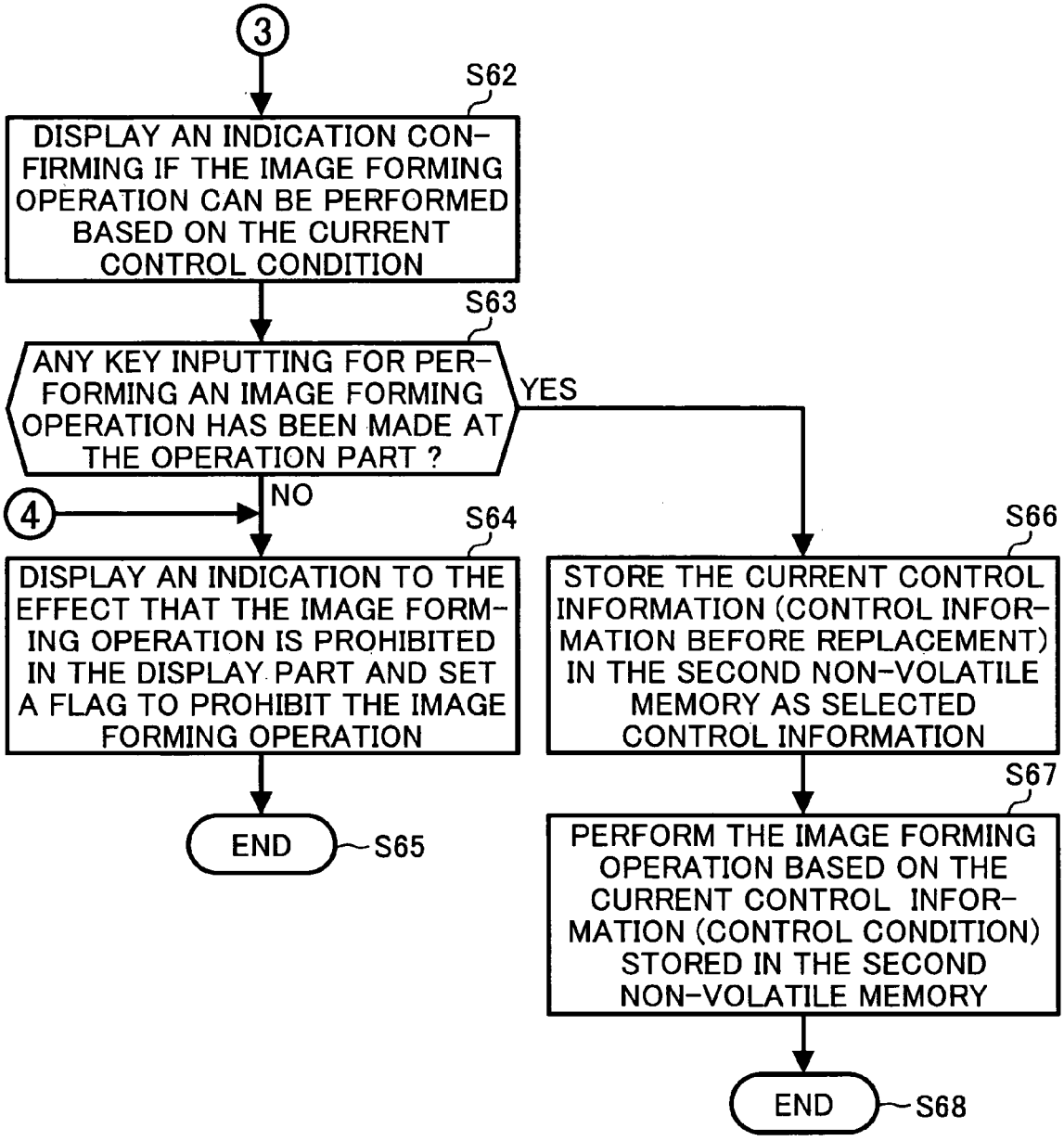

FIG. 7 is a flowchart of a control process in the operation part 90 integrated with the display part 90*a*, and is a flowchart following step S11 of FIG. 5.

As illustrated in FIG. 7, at the operation part 90, following step S11 of FIG. 5, it is first determined if recognition information of the process cartridge 20 exists (step S51 and step S52). Specifically, it is determined if the flag that recognition information corresponding to the process cartridge 20 does not exist (i.e., corresponding PC recognition information does not exist) in step S10 of FIG. 5 is set.

When it has been determined that the recognition information corresponding to the process cartridge 20 exists, the control process ends (step S53).

When it has been determined as that the recognition information corresponding to the process cartridge 20 does not exist, an indication to that effect is displayed in the display part 90*a* (step S55). For example, an indication that control information corresponding to the installed process cartridge 20 cannot be selected and optimum image quality cannot be guaranteed is displayed.

Then, it is determined if standard control information is held in the second non-volatile memory 111 (step S56).

When it has been determined that standard control information is held in the second non-volatile memory 111, an indication confirming if the operation of the image forming apparatus can be continued based on the standard control information is displayed in the display 90*a* (step S57). For example, an indication confirming if the image forming operation can be performed based on the standard control information is displayed in the display part 90*a*.

Then, it is determined if the operation of the image forming apparatus can be continued (step S58). Specifically, it is determined if key inputting for performing an image forming operation has been made at the operation part 90.

When it has been determined that the operation can be continued (key inputting for performing an image forming operation has been made), the standard control information is stored in the second non-volatile memory 111 as the selected control information (step S59).

Further, after going thorough the process illustrated in FIG. 8, an image forming operation is performed based on the standard control information (control condition) stored in the second non-volatile memory 111 (step S60). At this time, the image forming apparatus operates based on the standard control condition, which is acceptable though it does not perfectly accord with the control condition of the process cartridge 20 installed as a replacement.

The control process then ends (step S61).

When it has been determined in step S58 that the operation cannot be continued (i.e., no key inputting has been made), an indication that the image forming operation is prohibited is displayed in the display part 90*a*, and a flag to prohibit the image forming operation is set in the working memory of the controller 100 (step S64).

Then, the control process ends (step S65).

When it has been determined in step S56 that standard control information is not held in the second non-volatile memory 111, an indication confirming if the operation of the image forming apparatus can be continued is displayed in the display 90*a* (step S62). For example, an indication confirming if the image forming operation can be performed based on the current control condition is displayed in the display part 90*a*.

Then, it is determined if the operation of the image forming operation can be continued as it is (step S63). Specifically, it is determined if any key inputting for performing an image forming operation has been made at the operation part 90.

When it has been determined as that the operation cannot be continued (i.e., no key inputting has been made), after going through the process of step S64, the control process ends (step S65).

When it has been determined as that the operation can be continued (i.e., key inputting has been made), the current control information (control information before replacement) is stored in the second non-volatile memory 111 as the selected control information (step S66).

Further, after going through the process of FIG. 8, the image forming operation is performed based on the current control information (control condition) stored in the second non-volatile memory 111 (step S67). At this time, the image forming apparatus operates based on the control condition that has been proven although it does not perfectly accord with the control condition of the process cartridge 20 installed as a replacement.

The control process then ends (step S68).

FIG. 8 is a flowchart of a control process concerning an image forming operation, and illustrates processes before reaching the image forming operation described at each of step S8, step S14, and step S17 of FIG. 5, and step S60 and step S67 of FIG. 7.

First, it is determined if a flag prohibiting the image forming operation is set (step S71 and step S72). Specifically, it is determined if the flag prohibiting the image forming operation of step S64 of FIG. 7 exists.

When it has been determined that the flag prohibiting the image forming operation exists (i.e., the image forming operation cannot be performed), the control process ends (step S73).

When it has been determined that the flag prohibiting the image forming operation does not exist (i.e., the image performing operation can be performed), it is further determined if inputting of a start key for performing the image forming operation has been made at operation part 90 (step S74). When it has been determined in step S74 as that inputting of the start key has not been made, the control process ends (step S75).

When it has been determined that the start key inputting has been made, it is determined if the control information concerning the second recognition information according with the recognition information (stored in step S7 of FIG. 5) is stored in the second non-volatile memory 111 (step S76).

When it has been determined that the control information concerning the second recognition information according with the recognition information is stored in the second non-volatile memory 111, the image forming operation is performed based on the control condition concerning the control information stored in the second non-volatile memory 111 (step S78).

Thereafter, the recognition information of the process cartridge 20 installed as a replacement (and with which the image forming operation has been performed in step S78) is stored in the second non-volatile memory 111 of the main body 1 in preparation for the next replacement of the process cartridge 20 (step S86).

Then, the control process ends (step S87).

When it has been determined in step S76 that the control information concerning the second recognition information according with the recognition information is not stored in the second non-volatile memory 111, it is further determined if control information concerning a control condition resembling the control condition of the recognition information, i.e., compatible control information (stored in step S13 of FIG. 5), is stored in the second non-volatile memory 111 (step S79).

When it has been determined that compatible control information is stored in the second non-volatile memory 111, the image forming operation is performed based on the control condition concerning the compatible control information (step S80).

Thereafter, after going through step S86, the control process ends (step S87).

When it has been determined in step S79 that the compatible control information is not stored in the second non-volatile memory 111, it is further determined if standard control information (stored in step S59 of FIG. 7) is stored in the second non-volatile memory 111 (step S82).

When it has been determined that the standard control information is stored in the second non-volatile memory 111, the image forming operation is performed based on the control condition concerning the standard control information (step S83).

Thereafter, after going through step S86, the control process ends (step S87).

When it has been determined in step S82 that the standard control information is not stored in the second non-volatile memory 111, the image forming operation is performed based on the control condition concerning the current control information (stored in step S66 of FIG. 7) (step S85).

Thereafter, after going through step S86, the control process ends (step S87).

As illustrated in FIG. 5 through FIG. 8, even when control information according with or resembling the process cartridge 20 installed as a replacement is not stored in the second non-volatile memory 111, the user can be informed of such based on indications displayed in the display part 90*a*. Therefore, the user can select a subsequent operation based on the indications from a broad variety of choices.

As described above, in the above-described image forming apparatus according to the preferred embodiment of the present invention, even when the process cartridge 20 of a different type (e.g., different in manufacturer, whether it is a newly manufactured one or a recycled one, the number of times of recycling, version, color, etc.) has been installed in the main body 1 as a replacement and control information perfectly according with the control condition of the process cartridge 20 is not available at the side of the main body 1, resembling control information, standard control information or current control information can be selected as control information. Thus, according to the above-described preferred embodiment of the present invention, an image forming apparatus and units for installation in the image forming apparatus are provided, that are operated in an optimum image forming condition as often as possible and therefore, can be used by the user without anxiety.

Figure 9:
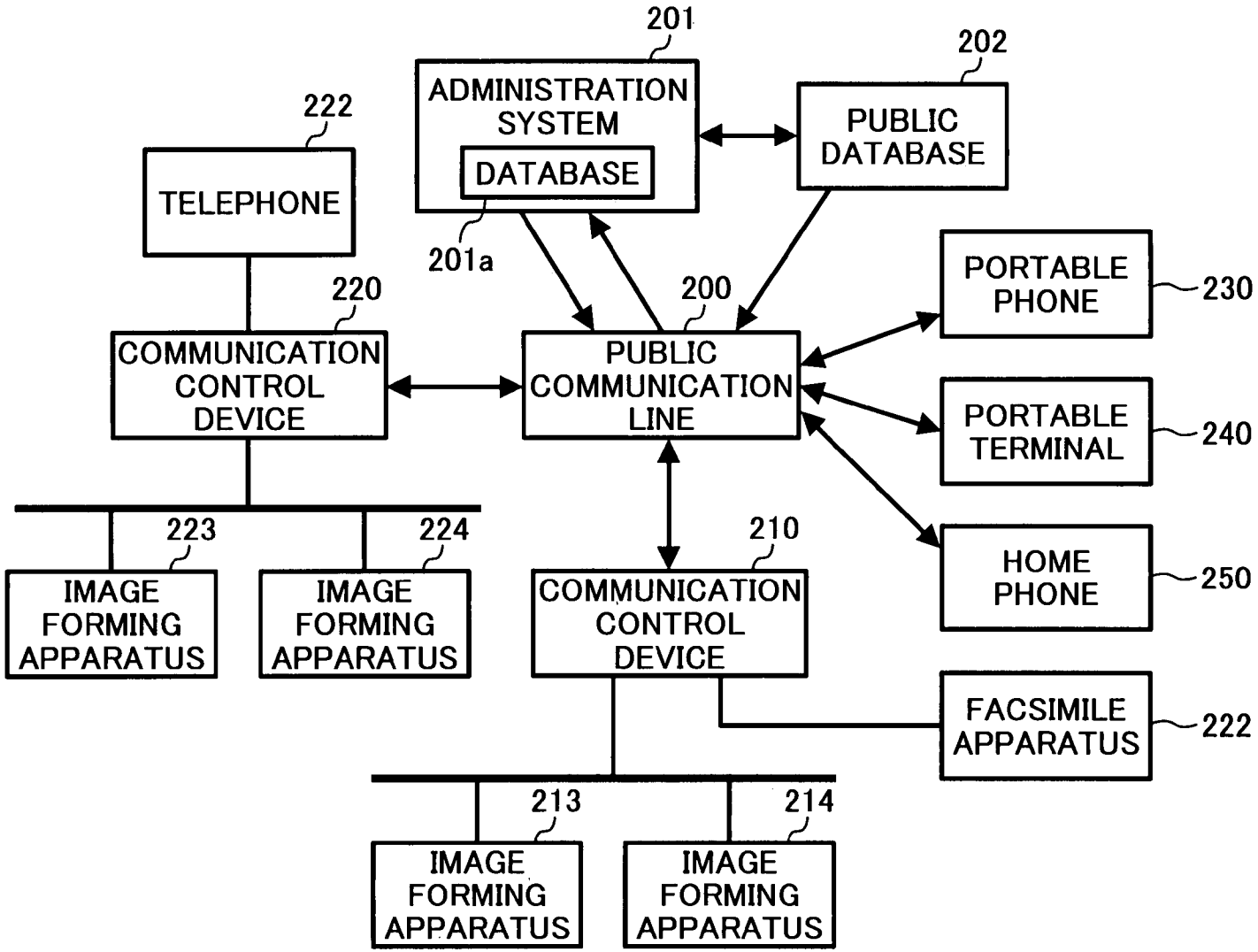
FIG. 9 is a concept diagram illustrating a state that the image forming apparatus of FIG. 1 is connected with an administration system via a public communication line.
Figure 10:
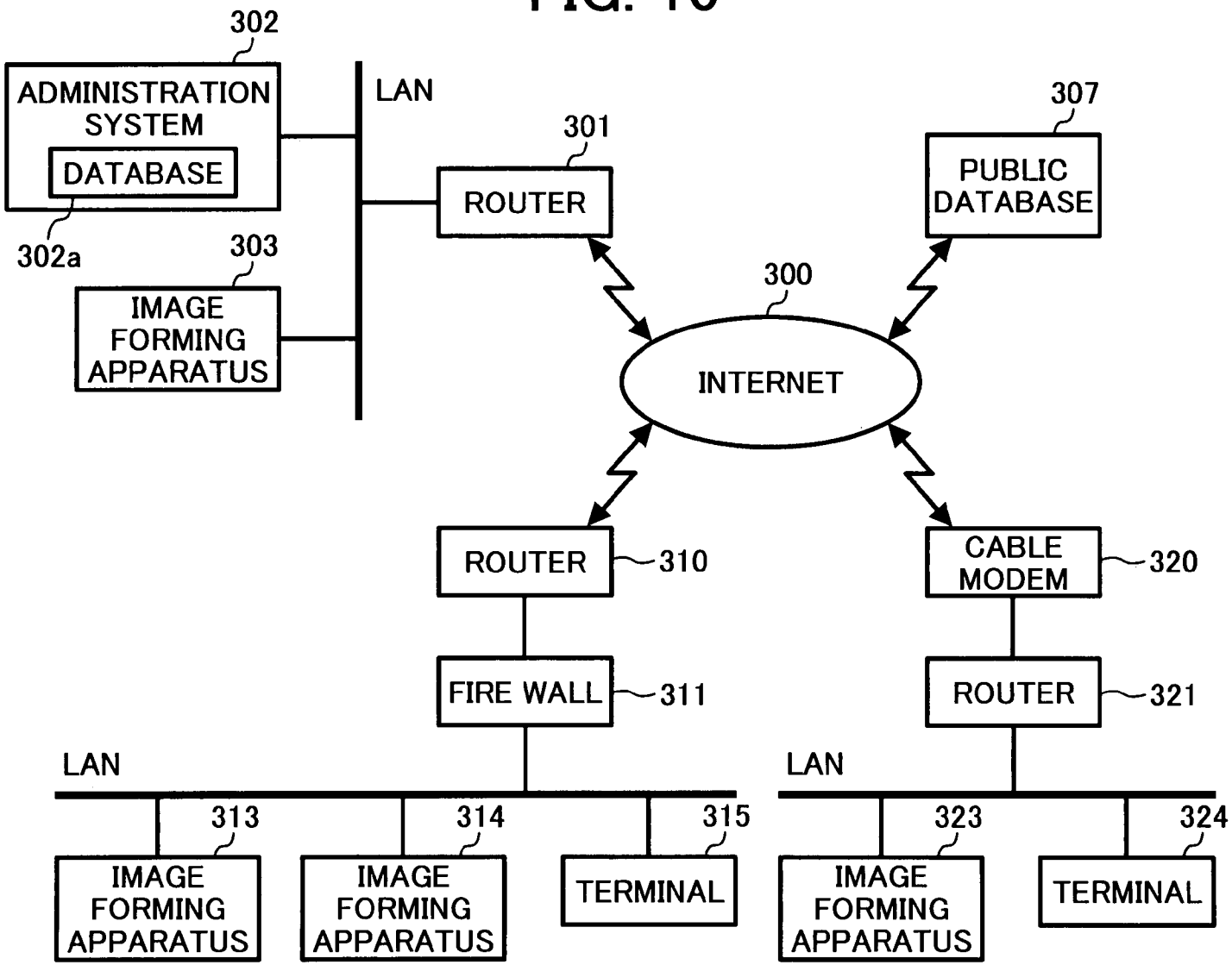
FIG. 10 is a concept diagram illustrating a state that the image forming apparatus of FIG. 1 is connected with an administration system via the Internet.

Now, referring to FIG. 9 and FIG. 10, the administration system, with which the above-described image forming apparatus can be connected, is described.

As described above, the image forming apparatus is configured to connect with a public communication line or the Internet.

FIG. 9 is a concept diagram illustrating a state that plural image forming apparatuses are connected with the administration system via a public communication line. FIG. 10 illustrates a state that plural image forming apparatuses are connected with the administration system via the Internet.

The image forming apparatuses of FIG. 9 and FIG. 10 are equivalents of the image forming apparatus described with reference to FIG. 1 through FIG. 4, respectively, except that the second non-volatile memory 111 of the controller 100 in the main body 1 holds second recognition information and corresponding control information.

Here, the second recognition information held by the second non-volatile memory 111 is information, such as recognition codes, etc., for identifying the type of the process cartridge 20 installed in the main body 1. That is, assuming that a process cartridge 20 of various types is installed in the main body 1, the second non-volatile memory 111 holds a plurality of recognition information corresponding to a plurality of process cartridges that might be installed in the main body 1, as the second recognition information.

The control information held by the second non-volatile memory 111 is information concerning the process cartridge 20, necessary for controlling an image forming apparatus and corresponding to the second recognition information.

As illustrated in FIG. 9, two image forming apparatuses 213 and 214 are connected, together with a facsimile apparatus 222, with a communication control device 210. Another two image forming apparatuses 223 and 224 are connected, together with a telephone 222, with another communication control device 220. The communication control devices 210 and 220 are connected, via a public communication line 200, with an administration system 201 as an administration center to monitor the status of the image forming apparatuses 213, 214, 223 and 224.

With the above-described configuration, each of the image forming apparatuses 213, 214, 223 and 224 can exchange information with the administration system 201 via the public communication line 200.

Specifically, at each of the image forming apparatuses 213, 214, 223, and 224, when the recognition information held in the first non-volatile memory 157 does not accord with the second recognition information held in the second non-volatile memory 111, the recognition information held in the first non-volatile memory 157 is transmitted to the administration system 201 via the public communication line 200. Thereby, an administrator operating the administration system 201, while being remotely located, can acquire in real time the recognition information of the process cartridge 20 installed as a replacement in each of the image forming apparatuses 213, 214, 223, and 224. At the administration system 201, checking of the acquired recognition information with a plurality of third recognition information held in a database 201*a* is performed. Then, control information of the third recognition information corresponding to the acquired recognition information, held in the database 201*a*, is transmitted to the corresponding image forming apparatus 213, 214, 223 or 224 via the public communication line 200. Thereafter, the corresponding image forming apparatus 213, 214, 223 or 224 having received the transmitted information, performs adjustment and control based on the received information. Thus, while being remotely located, the administrator operating the administration system 201 can adjust the image forming apparatuses 213, 214, 223 and 224 to have optimum use conditions.

As illustrated in FIG. 9, the administration system 201 is configured to access a public database 202, which is a database concerning control information of process cartridges provided by manufacturers other than manufacturers of the image forming apparatuses 213, 214, 223 and 224. Thereby, information volume of the plurality of third recognition information and corresponding control information held in the database 201*a* of the administration system 201 can be expanded. That is, third recognition information and corresponding control information that are not available in the database 201*a* can be supplemented by public database 202.

Further, the administration system 201 is connected with a portable phone 230, a portable terminal 240, and a home telephone 250. Thereby, an unspecified third party using the process cartridge 20 in an image forming apparatus of another manufacturer can access the database 201*a* and use the control information of the process cartridge 20.

In FIG. 10, two image forming apparatuses 313 and 314 are connected, together with a terminal 315, a router 310 and a firewall 311, thereby forming a LAN. Another image forming apparatus 323 is connected, together with a terminal 324, a router 321 and a cable modem 320, thereby forming another LAN. Further, an administration system 302 is connected, together with an image forming apparatus 303, a router 301, thereby forming a LAN as an administration center. Each of the LANs is connected with the Internet 300.

With the above-described configuration, each of the image forming apparatuses 303, 313, 314 and 323 can exchange information with the administration system 302 via the Internet 300.

Specifically, at each of the image forming apparatuses 303, 313, 314 and 323, when the recognition information held in the first non-volatile memory 157 does not accord with the second recognition information held in the second non-volatile memory 111, the recognition information held in the first non-volatile memory 157 is transmitted to the administration system 302 via the Internet 300. Thereby, an administrator operating the administration system 302, while being remotely located, can acquire in real time the recognition information of the process cartridge 20 installed as a replacement in each of the image forming apparatuses 303, 313, 314 and 323. At the administration system 302, checking the acquired recognition information with a plurality of third recognition information held in a database 302*a* is performed. Then, control information of the third recognition information corresponding to the acquired recognition information, held in the database 302*a*, is transmitted to the corresponding image forming apparatus 303, 313, 314 or 323 via the Internet 300. Thereafter, the corresponding image forming apparatus 303, 313, 314 or 323 having received the transmitted information, performs adjustment and control based on the received information. Thus, the administrator operating the administration system 302, while being remotely located, can adjust the image forming apparatuses 303, 313, 314 and 323 to have optimum conditions.

As illustrated in FIG. 10, the administration system 302 is configured to access a public database 307, which is a database concerning control information of process cartridges provided by manufacturers other than manufacturers of the image forming apparatuses 303, 313, 314 and 323. Thereby, the information volume of the plurality of third recognition information and corresponding control information held in the database 302*a* of the administration system 302 can be expanded. That is, third recognition information and corresponding control information that are not available in the database 302*a* can be supplemented by the public database 307.

Further, as in FIG. 9, the database 302*a* of the administration system 302 is configured to be accessible by unspecified third parties via the Internet 300.

Now, referring to FIGS. 11 through 16, control in each of the image forming apparatuses and the administration systems of FIG. 9 and FIG. 10 is described.

Figure 11:
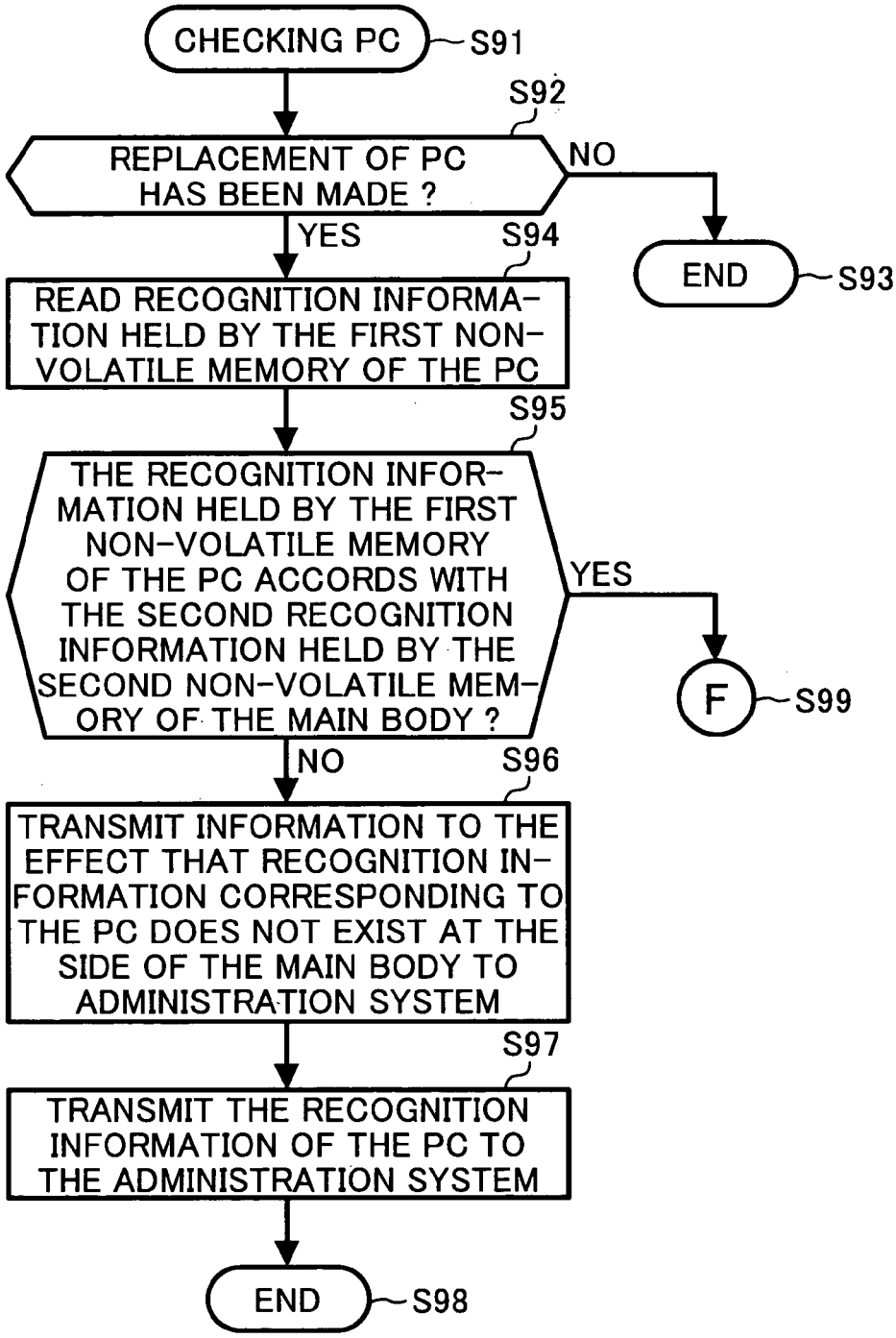
FIG. 11 is a flowchart of a control process of the image forming apparatus connected with the administration system of FIG. 9 or FIG. 10, when the process cartridge is installed in the main body.

FIG. 11 is a flowchart of a control process in each of the image forming apparatuses when the process cartridge 20 is installed in the main body 1.

First, a checking process of the process cartridge 20 (described as "PC" in flowcharts) is performed and it is determined if the process cartridge 20 in the main body has been replaced 1 (steps S91 and S92). The checking process is substantially the same as the one described above with reference to FIG. 6.

When it has been determined as that the process cartridge 20 has not been replaced, the control process ends (step S93).

When it has been determined in step S92 that the process cartridge 20 has been replaced, the recognition information held in the first non-volatile memory 157 of the process cartridge 20 is read at the controller 100 (step S94).

Then, the recognition information held in the first non-volatile memory 157 of the process cartridge 20 and the second recognition information held in the second non-volatile memory 111 of the main body 1 are compared with each other (step S95). Here, the second recognition information is, as described above, recognition information concerning a process cartridge or a plurality of process cartridges.

When it has been determined as that the recognition information accords with the second recognition information (or any of the plurality of second recognition information), the control process ends and proceeds to another process F (step S99). That is, the image forming apparatus is adjusted and controlled based on the control information corresponding to the second recognition information according with the recognition information.

On the other hand, when it has been determined in step S95 as that the recognition information does not accord with the second recognition information, i.e., when it has been determined that recognition information corresponding to the process cartridge 20 installed in the main body 1 as a replacement does not exist at the side of the main body 1, information to that effect and an administration number of the image forming apparatus are transmitted to the corresponding administration system 201 or 302 via the public communication line 200 or the Internet 300 (step S96), respectively.

Further, the recognition information of the process cartridge 20 installed as a replacement is transmitted to the corresponding administration system 201 or 302 (step S97).

Then, the control process ends (step S98).

Figures 12, 12A:
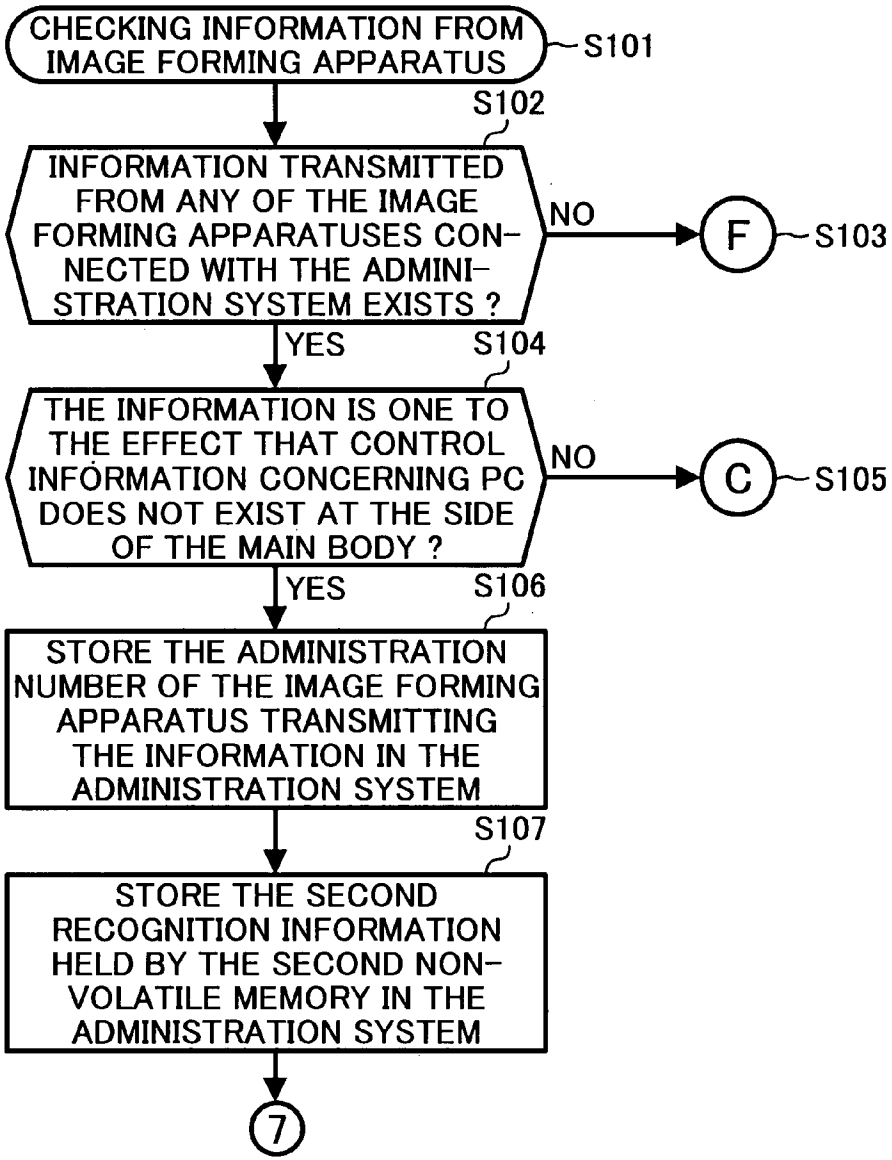
FIGS. 12A-12B are flowcharts of a control process in each of the administration systems of FIG. 9 and FIG. 10.
Figure 12B:
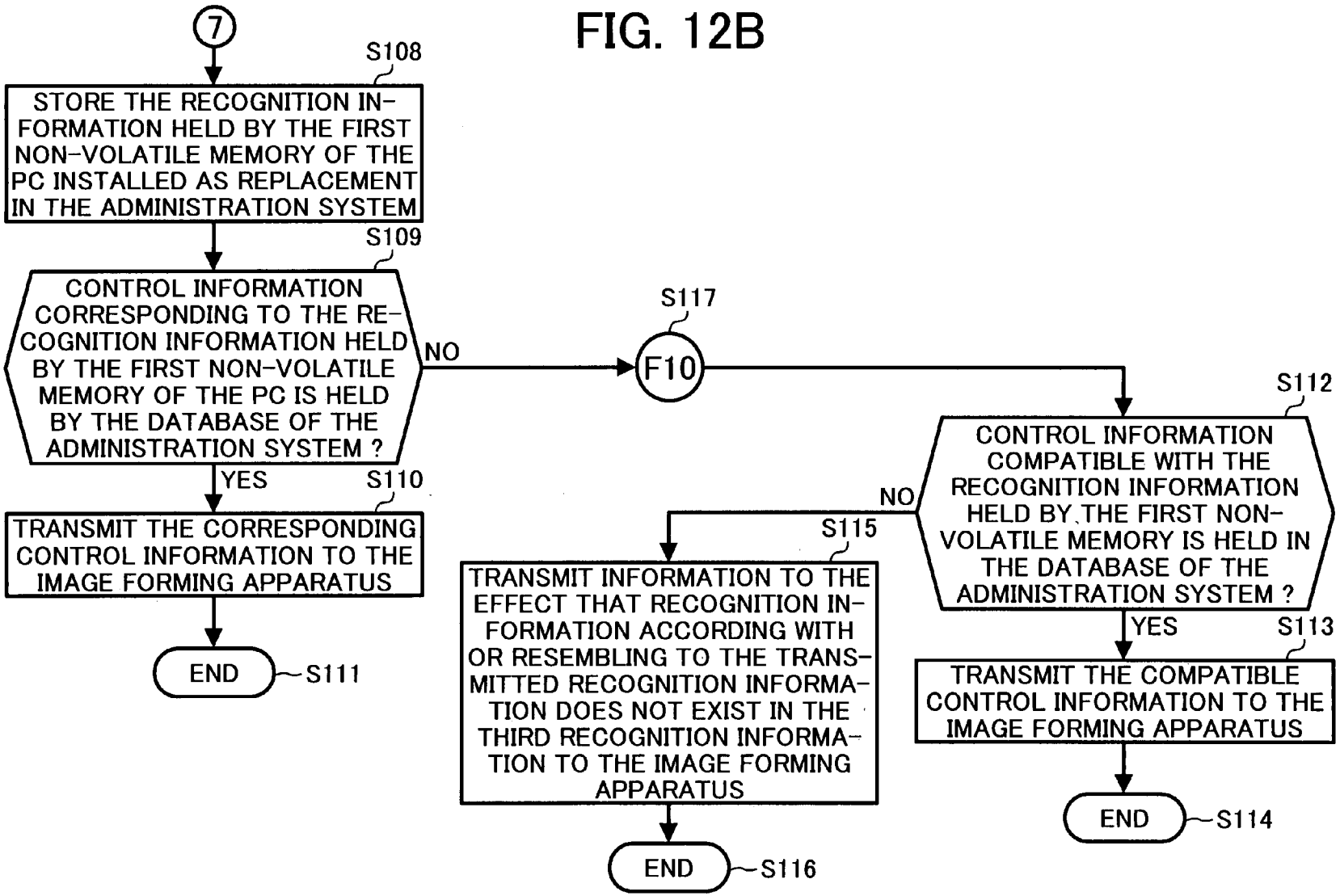

FIG. 12 is a flowchart illustrating a control process in each of the administration systems 201 and 302 described with reference to FIG. 9 and FIG. 10.

First, it is determined if information transmitted from any of the image forming apparatuses connected with the administration system 201 or 302 exists (step S101 and step S102).

When it has been determined that information transmitted from any of the image forming apparatuses does not exist, another process F is performed (step S103).

When it has been determined that information transmitted from any of the image forming apparatuses exists, it is further determined if the information is control information concerning the process cartridge 20 does not exist at the side of the main body 1 (step S104).

When it has been determined that the transmitted information is not the one to the effect that control information concerning the process cartridge 20 does not exist at the side of the main body 1, a checking process C of the transmitted information is performed (step S105).

On the other hand, when it has been determined that the transmitted information is control information concerning the process cartridge 20 does not exist at the side of the main body 1, the administration number of the image forming apparatus transmitting the information is stored in the corresponding administration system 201 or 302 (step S106). Further, the second recognition information held by the second non-volatile memory 111 of the image forming apparatus transmitting the information is stored in the corresponding administration system 201 or 302 (step S107), and the recognition information held in the first non-volatile memory 157 of the process cartridge 20 installed as a replacement in the main body 1 of the image forming apparatus transmitting the information is stored in the corresponding administration system 201 or 302 (step S108).

Thereafter, it is determined if control information corresponding to the recognition information stored in step S108 is held in the database 201*a* or 302*a* of the corresponding administration system 201 or 302 (step S109). Specifically, the transmitted recognition information concerning the process cartridge 20 is checked with the plurality of third recognition information of a plurality of types held in the database 201*a* or 302*a* of the corresponding administration system 201 or 302.

When it has been determined in step 109 that recognition information according with the transmitted recognition information exists in the plurality of third recognition information and corresponding control information exists, the corresponding control information is transmitted to the image forming apparatus transmitting the recognition information (step S110).

Then, the control process ends (step S111).

When it has been determined that recognition information according with the transmitted recognition information does not exist in the plurality of third recognition information in step S109, a process F10 concerning retrieval of the public database 202 or 307 is performed (step S117). Details of the process F10 are described later in reference to FIG. 13.

Thereafter, it is determined if control information compatible with the recognition information stored in step S108 is held in the database 201*a* or 302*a* of the corresponding administration system 201 or 302 (step S112). Specifically, the transmitted recognition information concerning the process of cartridge 20 is checked with the third recognition information concerning a plurality of types held in the database 201*a* or 302*a* of the corresponding administration system 201 or 302.

When it has been determined that recognition information which does not accord with, but resembles the transmitted recognition information exists in the plurality of third recognition information (i.e., the type of the process cartridge 20 concerning the transmitted recognition information resembles that of a process cartridge concerning the third recognition information) and corresponding control information (compatible control information) exists, the corresponding control information (compatible control information) is transmitted to the image forming apparatus transmitting the recognition information (step S113).

Then, the control process ends (step S114).

When it has been determined that recognition information which accords with or resembles the transmitted recognition information does not exist in the plurality of third recognition information, information to that effect is transmitted to the image forming apparatus transmitting the recognition information (step S115).

Then, the control process ends (step S116).

Figure 13:
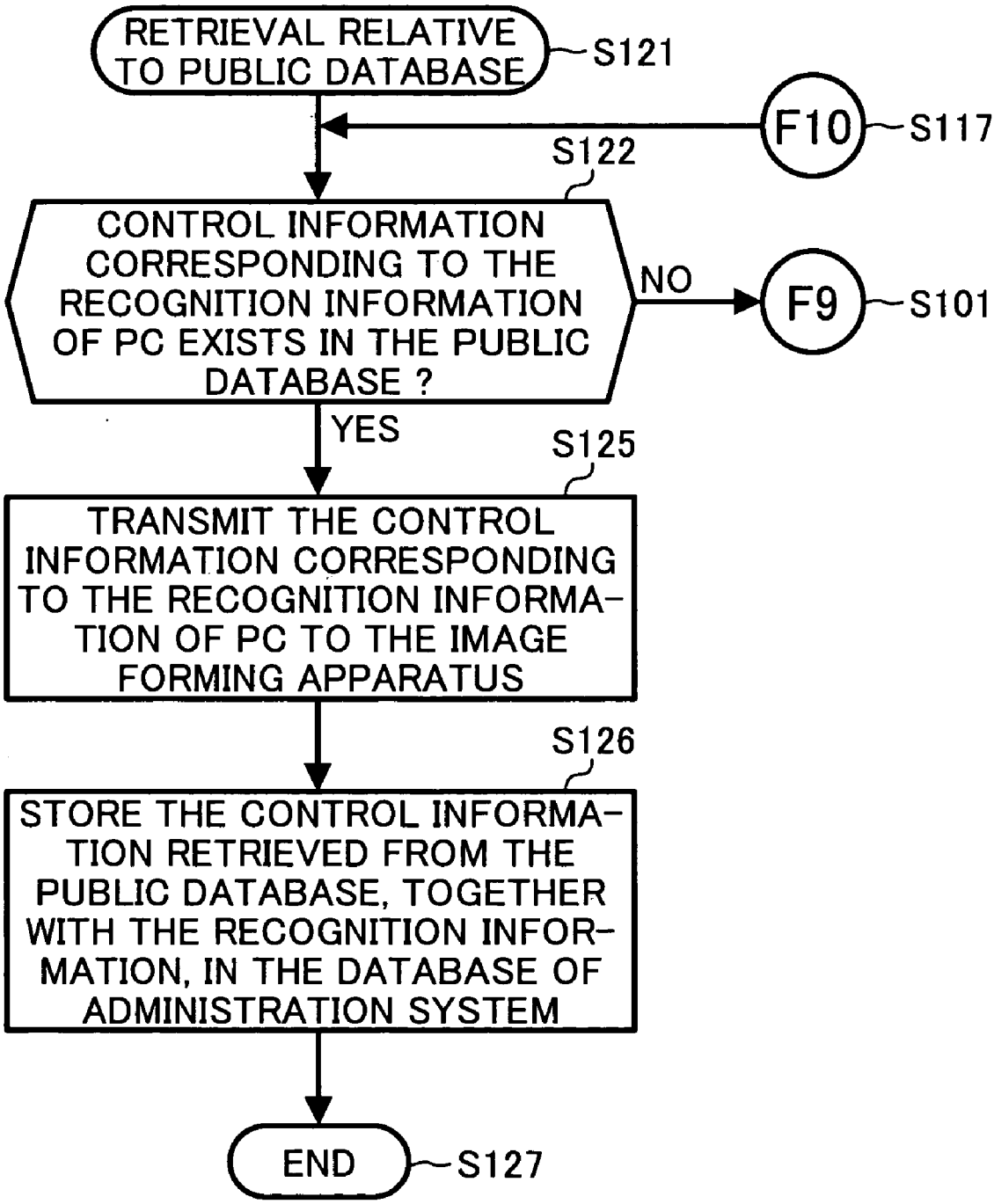
FIG. 13 is a flowchart of a control process in each of the administration systems, concerning retrieval relative to a public database.

FIG. 13 is a flowchart of a control process concerning retrieval relative to each of the public databases 202 and 307 in the administration systems 201 and 302. Here, the process F10 in step S117 of FIG. 12 is described in detail.

As illustrated in FIG. 13, in the control process concerning retrieval relative to each of the public databases 202 and 307 in the administration systems 201 and 302, first, the public database 202 or 307 is accessed and it is determined if control information corresponding to the recognition information of the process cartridge 20 of the image forming apparatus transmitting the recognition information exists (step S121 and step S122).

When it has been determined in step S122 that control information corresponding to the recognition information of the process cartridge 20 of the image forming apparatus transmitting the recognition information does not exist, the control process ends and proceeds to the process F9 in step S101 of FIG. 12.

On the other hand, when it has been determined in step S122 that control information corresponding to the recognition information of the process cartridge 20 of the image forming apparatus transmitting the recognition information exists, the control information is transmitted to the image forming apparatus transmitting the recognition information (step S125).

Further, the control information retrieved from the public database 202 or 302 is stored, together with the recognition information, in the database 201*a* or 302*a* of the administration system 201 or 302 (step S126).

Then, the control process ends (step S127).

Figures 14, 14A:
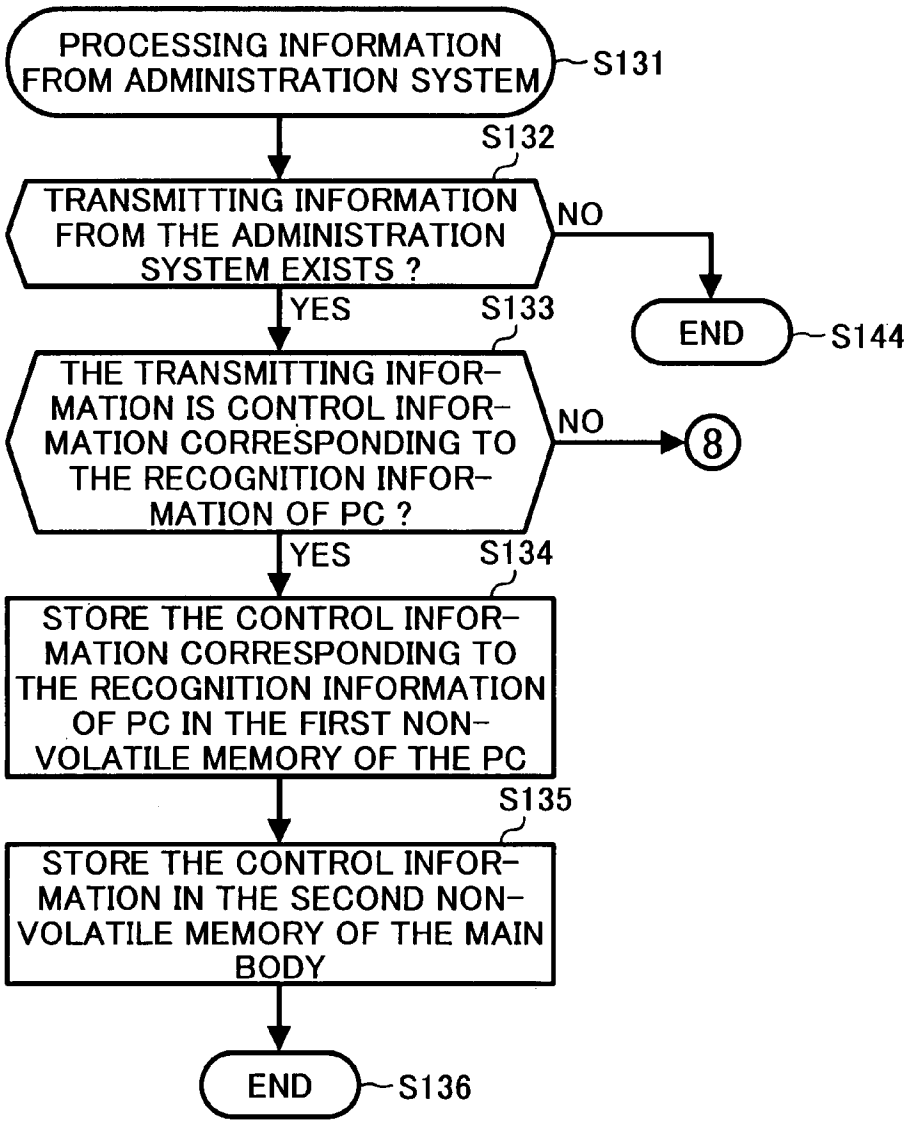
FIGS. 14A-14B are flowcharts of a control process in the image forming apparatus when transmitting information from the administration system is received and inputted.
Figure 14B:
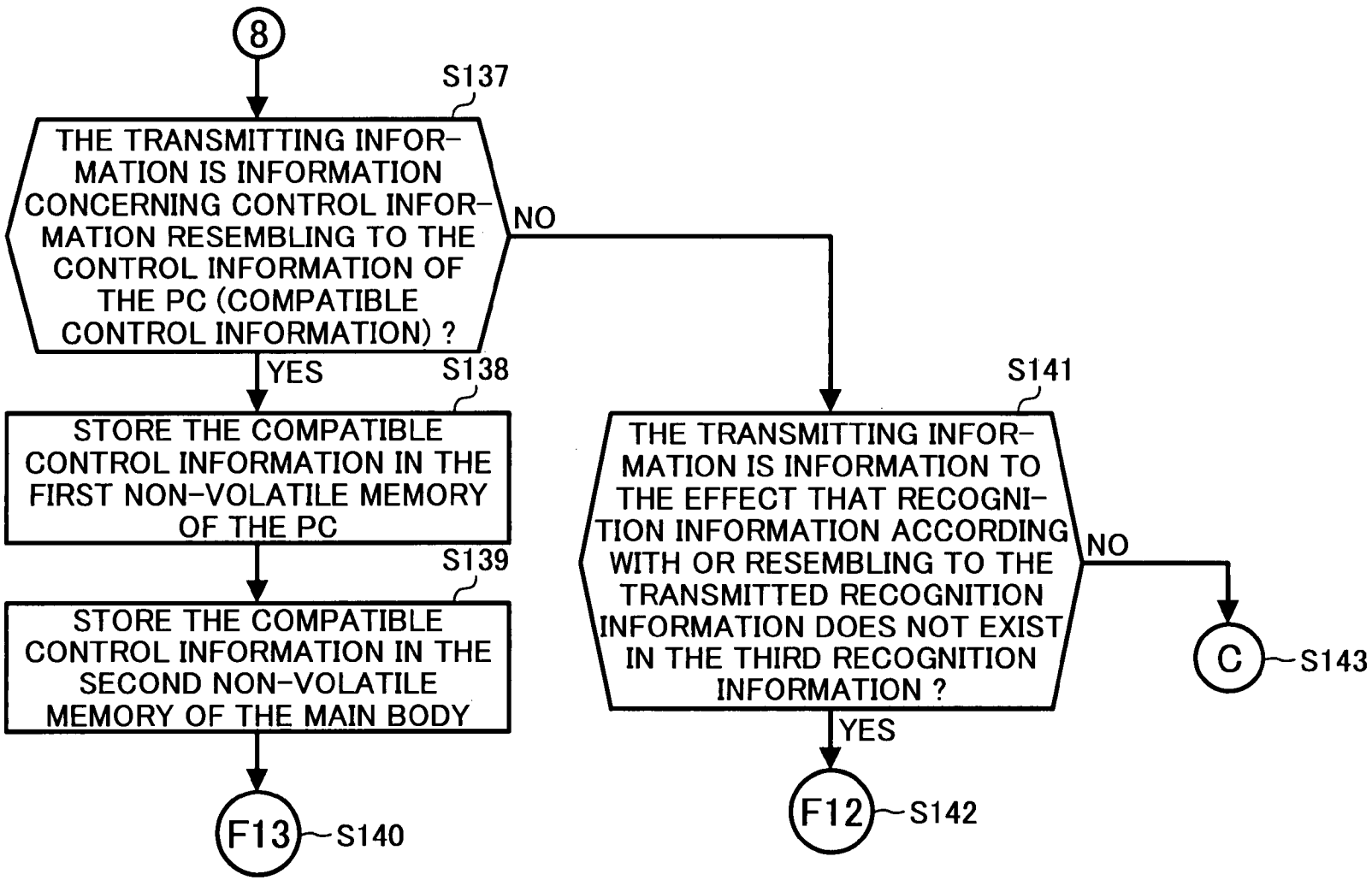

FIG. 14 is a flowchart of a control process in the image forming apparatus transmitting the recognition information when information from the administration system 201 or 302 is received and inputted.

First, it is determined if information transmitted from the administration system 201 or 302 exists (step S131 and step S132).

When it has been determined that information transmitted from the administration system 201 or 302 does not exist, the process ends (step S144).

On the other hand, when it has been determined that information transmitted from the administration system 201 or 302 exists, it is further determined if the received information is control information corresponding to the recognition information of the process cartridge 20 installed as a replacement (i.e., control information concerning step S110 of FIG. 12 or control information concerning step S125 of FIG. 13) (step S133).

When it has been determined that the received information is control information corresponding to the recognition information of the process cartridge 20 installed as a replacement, the received control information is stored in the first non-volatile memory 157 (step S134). Further, the received control information is stored in the second non-volatile memory 111 of the main body 1 (step S135), and the control process ends (step S136).

When it has been determined in step S133 that the received information is not control information corresponding to the recognition information of the process cartridge 20 installed as a replacement, it is further determined if the received information is information concerning control information resembling the control information of the process cartridge 20 (i.e., the compatible control information concerning step S113 of FIG. 12) (step S137).

When it has been determined that the received information is information concerning the compatible control information, the received compatible control information is stored in the first non-volatile memory 157 (step S138). Further, the compatible control information as the transmitting information is stored in the second non-volatile memory 111 of the main body 1 (step S139), and the control process proceeds to a flow F13 illustrated in FIG. 16 (step S140).

When it has been determined in step S137 that the received information is not compatible control information, it is further determined if the received information is information that recognition information which accords with or resembles the transmitted recognition information does not exist in the third recognition information (i.e., information concerning step S115 of FIG. 12) (step S141).

Figure 15:
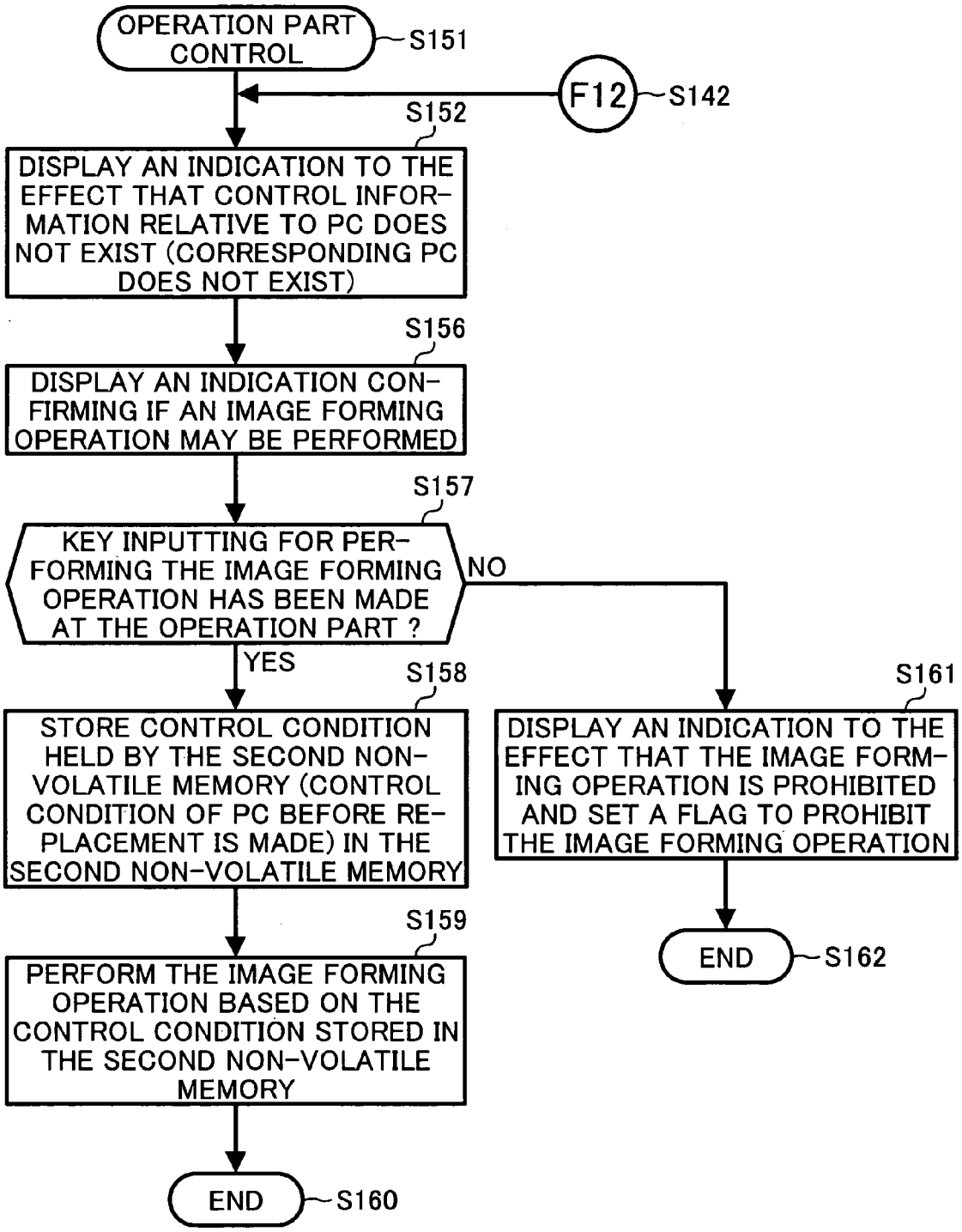
FIG. 15 is a flowchart of a control process in the image forming apparatus when transmitting information is received from the administration system and inputted, concerning control of an operation part, following FIG. 14.

When it has been determined that the received information is that recognition information according with or resembling the transmitted recognition information does not exist in the third recognition information, the control process proceeds to a process F12 illustrated in FIG. 15 (step S142). On the other hand, when it has been determined that the received information is not information indicating that recognition information which accords with or resembles to the transmitted recognition information does not exist in the third recognition information, the process proceeds to a checking process C relative to the received information (step S143).

FIG. 15 is a flowchart of a control process in the image forming apparatus when information is received from the administration system 201 or 302 and inputted, concerning control of an operation part, following step S142 of FIG. 14.

When it has been determined in step S141 of FIG. 14 that the received information is information that recognition information which accords with or resembles the transmitted recognition information does not exist in the third recognition information (step S142), an indication that control information relative to the process cartridge 20 installed as a replacement does not exist (corresponding PC does not exist) is displayed in the display part 90*a* of the operation part 90 (step S151 and step S152).

Then, an indication confirming if the operation of the image forming operation may be continued is displayed at the display part 90*a* (step S156). That is, an indication confirming if, although the control information of the process cartridge 20 installed as a replacement does not exist, an image forming operation can be performed is displayed.

Then, it is determined if the operation of the image forming apparatus can be continued (step S157). That is, it is determined if key inputting for performing the image forming operation has been made at the operation part 60.

When it has been determined that the operation of the image forming apparatus can be continued (i.e., key inputting has been made), the control condition held in the second non-volatile memory 111 (i.e., the control condition of the process cartridge 20 before replacement is made) is stored in the second non-volatile memory 111 (step S158).

Thereafter, the image forming operation is performed based on the control condition stored in the second non-volatile memory 111 in step S158 (step S159), and the control process ends (step S160).

On the contrary, when it has been determined in step S157 that the operation of the image forming apparatus cannot be continued (i.e., no key inputting has been made), an indication that the image forming operation is prohibited is displayed in the display part 90*a* and at the same time a flag to prohibit the image forming operation is set in the working memory of the controller 100 (step S161).

Then, the control process ends (step S162).

Figure 16:
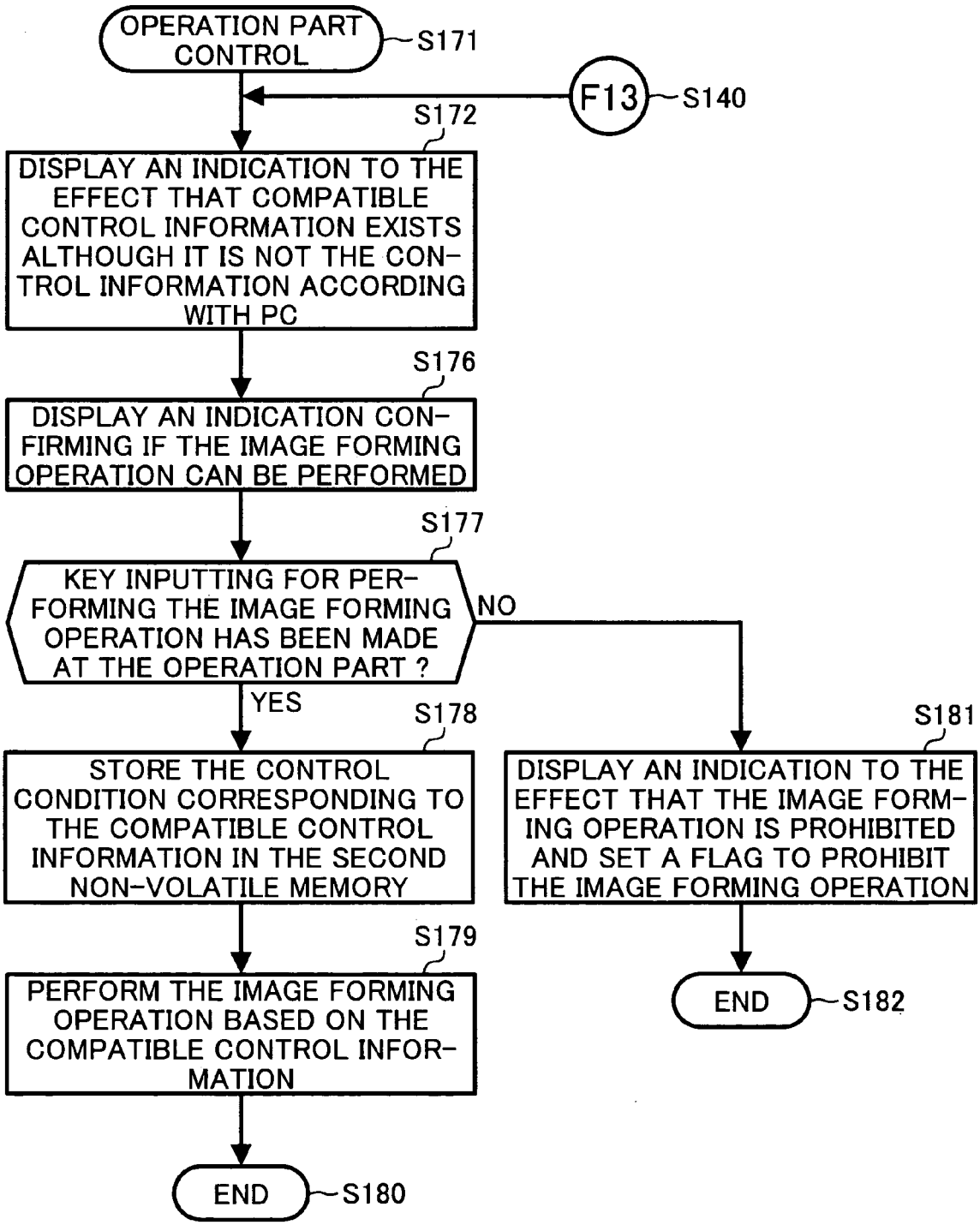
FIG. 16 is a flowchart of another control process in the image forming apparatus when transmitting information is received from the administration system and inputted, concerning the control of the operation part, following FIG. 14.

FIG. 16 is a flowchart of a control process in the image forming apparatus when information is received from the administration system 201 or 302 and inputted, concerning control of the operation part, following step S140 of FIG. 14.

When it has been determined that the transmitting information is the compatible control information in step S137 of FIG. 14, following step S138 and step S139, an indication that compatible control information exists, although it is not the control information according with the process cartridge 20 installed as a replacement, is displayed in the display part 90*a* of the operation part 90 (step S171 and step S172).

Then, an indication confirming if the operation of the image forming apparatus can be continued is displayed in the display 90*a* (step S176). That is, an indication confirming if an image forming operation can be performed based on the compatible control information relative to the process cartridge 20 installed as a replacement is displayed.

Further, it is determined if the operation of the image forming apparatus can be continued (step S177). That is, it is determined if key inputting for performing the image forming operation has been made at the operation part 90.

When it has been determined that the operation of the image forming apparatus can be continued (i.e., key inputting has been made), the control condition corresponding to the compatible control information is stored in the second non-volatile memory 111 (step S178).

Further, the image forming operation is performed based on the compatible control information stored in step S178 (step S179), and the control process ends (step S180).

On the other hand, when it has been determined in step S177 that the operation of the image forming operation cannot be continued (i.e., no key inputting has been made), an indication that the image forming operation is prohibited is displayed in the display part 90*a* and at the same time a flag to prohibit the image forming operation is set in the working memory of the controller 100 (step S181).

Then, the control process ends (step S182).

Thus, as illustrated in FIG. 15 and FIG. 16, even when the control information according with the control information of the process cartridge 20 installed as a replacement does not exist, the user can be so informed of from indications of the display part 90*a* and can select a subsequent operation from among a wide variety of choices based on the indications.

As described above, in each of the image forming apparatuses of FIG. 9 and FIG. 10, even when the process cartridge 20 of a different type (e.g., different in manufacturer, whether it is a newly manufactured one or a recycled one, the number of times of recycling, version, color, etc.) has been installed in the main body 1 as a replacement and control information corresponding to the process cartridge 20 is not held in the main body 1, optimum control information can be obtained as often as possible from the administration system 201 or 302. Thus, according to the above-described preferred embodiment of the present invention, an image forming apparatus is provided that can be operated in an optimum image forming condition independently of the type of a unit installed as a replacement in the image forming apparatus, and therefore, can be used by the user without anxiety. Further, units for installation in the image forming apparatus, and an administration system for the image forming apparatus are provided.

In the above-described embodiment, the description has been made using the process cartridge 20 for an example of a unit that that is installed in the image forming apparatus in a replaceable manner and that has a first non-volatile memory 157. However, the present invention can be applied to any unit that can be installed in the main body of an image forming apparatus in a replaceable manner and that, when installed in the main body, may cause differences in the quality of the image forming apparatus.

For example, the present invention can be applied to the optical unit 2, the transfer belt unit 24, the fixing unit 66, the sheet feeding unit 61 in FIG. 1, and the toner bottle (toner cartridge) 33 in FIG. 2. Further, in an image forming apparatus in which a process cartridge is not configured by units to perform an image forming operation, the present invention can be applied to an individual unit, such as a photoconductor drum, a charging unit, a development unit, a cleaning unit, a transfer unit, etc. Furthermore, the present invention can be applied to a composite unit in which two or more of the photoconductor drum, the charging unit, the development unit, the cleaning unit, the transfer unit are combined with each other in a configuration different from that of a process cartridge. In these cases, effects equivalent to those obtained in the above-described embodiment can be obtained.

Further, in the above-described embodiment, the present invention has been applied to a color image forming apparatus in which four process cartridges are installed. However, the present invention can be applied to various types of image forming apparatuses, such as one in which a single process cartridge is installed.

Furthermore, in the above-described embodiment, the engine control board 110 and the controller board 101 are individually provided in the controller 100 of the main body 1. However, the engine control board 110 and the controller board 101 can be integrated with each other in a single board.

Numerous additional modifications and variations of the present invention are possible in light of the above-teachings. It is therefore to be understood that within the scope of the claims, the present invention can be practiced otherwise than as specifically described herein. In particular, the numbers, the positions, the shapes of components are not limited to those described above, and can be appropriately determined.

What is claimed is:

1. An image forming apparatus, comprising:

a unit having a first non-volatile memory holding recognition information of the unit; and a main body in which the unit is installed in a replaceable manner, the main body has a second non-volatile memory holding second recognition information corresponding to the unit, wherein the image forming apparatus is configured to exchange information with an administration system monitoring a status of the image forming apparatus, and when a comparison is made between the recognition information held in the first non-volatile memory of the unit and the second recognition information held in the second non-volatile memory of the main body and the recognition information held in the first non-volatile memory does not accord with the second recognition information held in the second non-volatile memory, information is transmitted to the administration system, and wherein the second recognition information is a plurality of recognition information corresponding to a plurality of units, and when a comparison is made between the recognition information held in the first non-volatile memory of the unit and the second recognition information held in the second non-volatile memory of the main body, and the recognition information held in the first non-volatile memory does not accord with at least one of the plurality of recognition information of the second recognition information held in the second non-volatile memory, information is transmitted to the administration system.

2. The image forming apparatus according to claim 1, wherein the first non-volatile memory is provided by an IC tag configured to be detachable relative to the unit.

3. The image forming apparatus according to claim 1, wherein the second non-volatile memory is detachably mounted to a control part of the main body.

4. The image forming apparatus according to claim 1, wherein the first non-volatile memory is configured to exchange information with a control part of the main body by serial communication.

5. The image forming apparatus according to claim 1, wherein the first non-volatile memory and the second non-volatile memory are configured such that when the unit has been replaced, the comparison between the recognition information held in the first non-volatile memory and the second recognition information held in the second non-volatile memory is made.

6. The image forming apparatus according to claim 1, wherein the unit is a process cartridge in which at least one of a charging unit to charge an image bearing member, a development unit to develop a latent image formed on the image bearing member, and a cleaning unit to clean the image bearing member are supported integrally with the image bearing member.

7. The image forming apparatus according to claim 1, wherein the unit is an integrated unit in which at least one of an image bearing member, a charging unit to charge the image bearing member, a development unit to develop a latent image formed on the image bearing member, a transfer unit to transfer a toner image formed on the image bearing member to a transfer sheet, and a cleaning unit to clean the image bearing member are integrated.

8. The image forming apparatus according to claim 1, wherein the unit is a toner cartridge accommodating toner.

9. An image forming apparatus comprising:

a unit having a first non-volatile memory holding recognition information of the unit; and a main body in which the unit is installed in a replaceable manner, the main body has a second non-volatile memory holding second recognition information corresponding to the unit, wherein the image forming apparatus is configured to exchange information with an administration system monitoring a status of the image forming apparatus, and when a comparison is made between the recognition information held in the first non-volatile memory of the unit and the second recognition information held in the second non-volatile memory of the main body and the recognition information held in the first non-volatile memory does not accord with the second recognition information held in the second non-volatile memory, information is transmitted to the administration system, wherein the information transmitted to the administration system includes the recognition information held in the first non-volatile memory, and wherein the administration system holds a plurality of third recognition information corresponding to a plurality of units and a plurality of control information corresponding to the plurality of third recognition information and is configured to transmit, when third recognition information according with the transmitted recognition information is identified in the plurality of third recognition information, the third recognition information according with the transmitted recognition information to the image forming apparatus as information, and the image forming apparatus is configured to receive and input the information received from the administration system.

10. The image forming apparatus according to claim 9, wherein the administration system includes a database holding the plurality of third recognition information and the plurality of control information corresponding to the plurality of third recognition information and is configured to access a public database to supplement third recognition information according with the transmitted recognition information and corresponding control information to the database.

11. The image forming apparatus according to claim 9, wherein the information received and inputted from the administration system is held in the first non-volatile memory.

12. The image forming apparatus according to claim 9, wherein the information received and inputted from the administration system is held in the second non-volatile memory.

13. An image forming apparatus, comprising:

a unit having a first non-volatile memory holding recognition information of the unit; and a main body in which the unit is installed in a replaceable manner, the main body has a second non-volatile memory holding second recognition information corresponding to the unit, wherein the image forming apparatus is configured to exchange information with an administration system monitoring a status of the image forming apparatus, and when a comparison is made between the recognition information held in the first non-volatile memory of the unit and the second recognition information held in the second non-volatile memory of the main body and the recognition information held in the first non-volatile memory does not accord with the second recognition information held in the second non-volatile memory, information is transmitted to the administration system, wherein the information transmitted to the administration system includes the recognition information held in the first non-volatile memory, and wherein the administration system holds a plurality of third recognition information corresponding to a plurality of units and a plurality of control information corresponding to the plurality of third recognition information and is configured to transmit, when third recognition information according with the transmitted recognition information is not identified in the plurality of third recognition information, information that third recognition information according with the transmitted recognition information has not been identified in the plurality of third recognition information to the image forming apparatus, and the image forming apparatus is configured to receive and input the information received from the administration system.

14. The image forming apparatus according to claim 13, further comprising:

a display part; and an operation part, wherein the display part is configured to display, when the information has been inputted to the image forming apparatus, an indication that third recognition information according with the transmitted recognition information has not been identified in the plurality of third recognition information and a confirmation indication as to if an operation of the image forming apparatus may be continued, and wherein the operation part is configured for key inputting a confirmation that determines if the operation of the image forming apparatus may be continued.

15. An image forming apparatus, comprising:

a unit having a first non-volatile memory holding recognition information of the unit; and a main body in which the unit is installed in a replaceable manner, the main body has a second non-volatile memory holding second recognition information corresponding to the unit, wherein the image forming apparatus is configured to exchange information with an administration system monitoring a status of the image forming apparatus, and when a comparison is made between the recognition information held in the first non-volatile memory of the unit and the second recognition information held in the second non-volatile memory of the main body and the recognition information held in the first non-volatile memory does not accord with the second recognition information held in the second non-volatile memory, information is transmitted to the administration system, wherein the information transmitted to the administration system includes the recognition information held in the first non-volatile memory, and wherein the administration system holds a plurality of third recognition information corresponding to a plurality of units and a plurality of control information corresponding to the plurality of third recognition information and is configured to transmit, when third recognition information according with the transmitted recognition information is not identified in the plurality of third recognition information and third recognition information resembling the transmitted recognition information is identified in the plurality of third recognition information, control information corresponding to the third recognition information resembling the transmitted recognition information to the image forming apparatus, and the image forming apparatus is configured to receive and input the control information received from the administration system.

16. The image forming apparatus according to claim 15, further comprising:

a display part; and an operation part, wherein the display part is configured to display, when the control information has been inputted to the image forming apparatus, an indication that third recognition information resembling the transmitted recognition information has not been identified in the plurality of third recognition information and a confirmation indication as to if an operation of the image forming apparatus may be continued, and wherein the operation part is configured for key inputting a confirmation that determines if the operation of the image forming apparatus may be continued.

17. A method of operating an image forming apparatus in an optimum condition, comprising:

installing a unit having a first memory device holding recognition information of the unit in a main body of the image forming apparatus as a replacement, wherein the main body has a second memory device holding second recognition information concerning the unit; exchanging information with an administration system monitoring a use state of the image forming apparatus; and transmitting information to the administration system when the recognition information held in the first memory device of the unit and the second recognition information held in the second memory device of the main body and the recognition information held in the first memory device does not accord with the second recognition information held in the second memory device, wherein the second recognition information is a plurality of recognition information corresponding to a plurality of units, and wherein, transmitting information transmits information when the recognition information held in the first memory device of the unit and the second recognition information held in the second memory device of the main body and the recognition information held in the first memory device does not accord with at least one of the plurality of recognition information of the second recognition information held in the second memory device.

18. The method according to claim 17, wherein the first memory device is provided by an IC tag configured to be detachable relative to the unit.

19. The method according to claim 17, wherein the second memory device is detachably mounted to a control part of the main body.

20. The method according to claim 17, wherein the first memory device is configured to exchange information with a control part of the main body by serial communication.

21. The method according to claim 17, wherein the first memory device and the second memory device are configured such that when the unit has been replaced, comparing the recognition information held in the first memory device and the second recognition information held in the second memory device is completed.

22. The method according to claim 17, wherein the unit is a process cartridge including at least one of a charging unit to charge an image bearing member, a development unit to develop a latent image formed on the image bearing member, and a cleaning unit to clean the image bearing member are supported integrally with the image bearing member.

23. The method according to claim 17, wherein the unit is an integrated unit in which at least one of an image bearing member, a charging unit to charge the image bearing member, a development unit to develop a latent image formed on the image bearing member, a transfer unit to transfer a toner image formed on the image bearing member to a transfer sheet, and a cleaning unit to clean the image bearing member are integrated.

24. The method according to claim 17, wherein the unit is a toner cartridge accommodating toner.

25. The method according to claim 17, wherein exchanging information with the administration system and the image forming apparatus is exchanged via a public communication line or an Internet.

26. The method according to claim 17, wherein the administration system includes a database holding a plurality of third recognition information corresponding to a plurality of units and a plurality of control information corresponding to the plurality of third recognition information, and the database is configured to be accessible by unidentified third parties.

27. A method of operating an image forming apparatus in an optimum condition, comprising:

installing a unit having a first memory device holding recognition information of the unit in a main body of the image forming apparatus as a replacement, wherein the main body has a second memory device holding second recognition information concerning the unit;

exchanging information with an administration system monitoring a use state of the image forming apparatus;

transmitting information to the administration system when the recognition information held in the first memory device of the unit and the second recognition information held in the second memory device of the main body and the recognition information held in the first memory device does not accord with the second recognition information held in the second memory device, wherein transmitting information transmits information to the administration system that includes the recognition information held in the first memory device;

holding a plurality of third recognition information in the administration system corresponding to a plurality of units and a plurality of control information corresponding to the plurality of third recognition information;

transmitting third recognition information according with the transmitted recognition information to the image forming apparatus when third recognition information according with the transmitted recognition information is identified in the plurality of third recognition information, receiving the third recognition information from the administration system with the image forming apparatus, and inputting the third recognition information received from the administration system into the image forming apparatus.

28. The method according to claim 27, further comprising:

supplementing the plurality of third recognition information and the plurality of control information corresponding to the plurality of third recognition information by accessing a public database to supplement third recognition information according with the transmitted recognition information and corresponding control information to the database.

29. The method according to claim 27, wherein inputting information received from the administration system includes storing the information in the first memory device.

30. The method according to claim 27, wherein inputting the third recognition information received from the administration system inputs the third recognition information into the second memory device.

31. A method of operating an image forming apparatus in an optimum condition, comprising:

installing a unit having a first memory device holding recognition information of the unit in a main body of the image forming apparatus as a replacement, wherein the main body has a second memory device holding second recognition information concerning the unit; exchanging information with an administration system monitoring a use state of the image forming apparatus;

transmitting information to the administration system when the recognition information held in the first memory device of the unit and the second recognition information held in the second memory device of the main body and the recognition information held in the first memory device does not accord with the second recognition information held in the second memory device, wherein transmitting information transmits information to the administration system that includes the recognition information held in the first memory device, and wherein the administration system holds a plurality of third recognition information corresponding to a plurality of units and a plurality of control information corresponding to the plurality of third recognition information, and wherein transmitting information includes transmitting information that third recognition information according with the transmitted recognition information has not been identified in the plurality of third recognition information, further comprising:

receiving the information from the administration system using the image forming apparatus; and inputting the information received from the administration system into the image forming apparatus.

32. The method according to claim 31 further comprising:

displaying an indication that third recognition information according with the transmitted recognition information has not been identified in the plurality of third recognition information and a confirmation indication as to if an operation of the image forming apparatus may be continued in a display part of the image forming apparatus; and accepting a key inputting confirmation that determines if the operation of the image forming apparatus may be continued that is inputted in an operation part of the image forming apparatus.

33. A method of operating an image forming apparatus in an optimum condition, comprising:

installing a unit having a first memory device holding recognition information of the unit in a main body of the image forming apparatus as a replacement, wherein the main body has a second memory device holding second recognition information concerning the unit; exchanging information with an administration system monitoring a use state of the image forming apparatus;

transmitting information to the administration system when the recognition information held in the first memory device of the unit and the second recognition information held in the second memory device of the main body and the recognition information held in the first memory device does not accord with the second recognition information held in the second memory device, wherein transmitting information transmits information to the administration system that includes the recognition information held in the first memory device, and wherein the administration system holds a plurality of third recognition information concerning a plurality of units and a plurality of control information corresponding to the plurality of third recognition information, and wherein transmitting includes transmitting control information resembling the transmitted recognition information when third recognition information according with the transmitted recognition information is not identified in the plurality of third recognition information and third recognition information resembling the transmitted recognition information is identified in the plurality of third recognition information, further comprising:

receiving the control information from the administration system with the image forming apparatus; and inputting the control information received from the administration system into the image forming apparatus.

34. The method according to claim 33 further comprising:

displaying an indication that third recognition information resembling the transmitted recognition information has not been identified in the plurality of third recognition information and a confirmation indication as to if an operation of the image forming apparatus may be continued in a display part of the image forming apparatus; and accepting a key inputting confirmation that determines if the operation of the image forming apparatus may be continued that is inputted in an operation part of the image forming apparatus.

* * * * *